US010743109B1

(12) United States Patent
Campbell et al.

(10) Patent No.: US 10,743,109 B1
(45) Date of Patent: Aug. 11, 2020

(54) ORDERED PICKLIST FOR LIQUID TRANSFER

(71) Applicant: Recursion Pharmaceuticals, Inc., Salt Lake City, UT (US)

(72) Inventors: Nicholas Campbell, Salt Lake City, UT (US); Charles Baker, Salt Lake City, UT (US)

(73) Assignee: Recursion Pharmaceuticals, Inc., Salt Lake City, UT (US)

( * ) Notice: Subject to any disclaimer, the term of this patent is extended or adjusted under 35 U.S.C. 154(b) by 0 days.

(21) Appl. No.: 16/814,572

(22) Filed: Mar. 10, 2020

(51) Int. Cl.

| | |
|---|---|
| ***B01L 3/00*** | (2006.01) |
| ***H04R 7/08*** | (2006.01) |
| ***H04R 17/02*** | (2006.01) |
| ***H04R 1/42*** | (2006.01) |

(52) U.S. Cl.
CPC ..... *H04R 7/08* (2013.01); *H04R 1/42* (2013.01); *H04R 17/02* (2013.01)

(58) Field of Classification Search
CPC ..... H04R 7/08; H04R 1/42; B41J 2/14008
See application file for complete search history.

(56) References Cited

U.S. PATENT DOCUMENTS 5,565,113 A * 10/1996 Hadimioglu ..... B41J 2/14008 216/2
5,631,678 A * 5/1997 Hadimioglu ..... B41J 2/14008 347/19
6,861,034 B1 * 3/2005 Elrod ..... B01L 3/0268 422/501
2002/0037527 A1 * 3/2002 Ellson ..... B01J 19/0046 435/6.11
2002/0061598 A1 * 5/2002 Mutz ..... B41J 2/04 506/40
2002/0094582 A1 * 7/2002 Williams ..... F04F 7/00 436/180
2002/0191048 A1 * 12/2002 Mutz ..... C07K 1/306 347/46
2003/0085952 A1 * 5/2003 Williams ..... B01L 3/50853 347/46
2003/0101819 A1 * 6/2003 Mutz ..... G01F 23/2968 506/12
2004/0102742 A1 * 5/2004 Tuyl ..... G01N 35/1074 604/298

(Continued)

*Primary Examiner* — Brian R Gordon

(57) ABSTRACT

An acoustic liquid transfer system that includes a processor; a source holding component configured to hold a source microplate; a destination holding component configured to hold a destination microplate; an acoustic transducer configured to cause liquid to transfer between the source and destination microplates; and a controller configured to direct movements, according to an ordered picklist, of one or more of the: source holding component, destination holding component, and acoustic transducer. The processor is configured to access an initial picklist of a plurality of source/destination pairs; obtain a current source/destination pair on the ordered picklist being created; calculate a plurality of movement metrics between the current source/destination pair and at least some of the plurality of source/destination pairs on the initial picklist but not yet on the ordered picklist; select a next source/destination pair with reference to the movement metrics; and add the next source/destination pair to the ordered picklist.

21 Claims, 11 Drawing Sheets

(56) References Cited

U.S. PATENT DOCUMENTS

| | | | | |
|---|---|---|---|---|
| 2004/0112978 | A1* | 6/2004 | Reichel | G01N 35/028 239/71 |
| 2005/0212869 | A1* | 9/2005 | Ellson | G01F 23/296 347/75 |
| 2006/0158956 | A1* | 7/2006 | Laugharn, Jr. | B01F 11/02 366/127 |
| 2006/0275883 | A1* | 12/2006 | Rathgeber | B01F 11/0266 435/173.1 |
| 2011/0181663 | A1* | 7/2011 | Ellson | B41J 2/04575 347/46 |
| 2014/0283627 | A1* | 9/2014 | Hattingh | G01N 21/6404 73/864.81 |
| 2015/0316480 | A1* | 11/2015 | Seidel | B01L 3/5027 250/459.1 |

* cited by examiner

521-A1

120B

| | 1 | 2 | 3 | 4 | 5 ••• 44 | | 45 | 46 | 47 | 48 |
|---|---|---|---|---|---|---|---|---|---|---|
| A | A1 | A2 | A3 | A4 | A5 | A44 | A45 | A46 | A47 | A48 |
| B | B1 | B2 | B3 | B4 | B5 | B44 | B45 | B46 | B47 | B48 |
| C | C1 | C2 | C3 | C4 | C5 | C44 | C45 | C46 | C47 | C48 |
| ⋮ | | | | | | | | | | |
| Z | Z1 | Z2 | Z3 | Z4 | Z5 | Z44 | Z45 | Z46 | Z47 | Z48 |
| AA | AA1 | AA2 | AA3 | AA4 | AA5 | AA44 | AA45 | AA46 | AA47 | AA48 |
| AB | AB1 | AB2 | AB3 | AB4 | AB5 | AB44 | AB45 | AB46 | AB47 | AB48 |
| AC | AC1 | AC2 | AC3 | AC4 | AC5 | AC44 | AC45 | AC46 | AC47 | AC48 |
| AD | AD1 | AD2 | AD3 | AD4 | AD5 | AD44 | AD45 | AD46 | AD47 | AD48 |
| AE | AE1 | AE2 | AE3 | AE4 | AE5 | AE44 | AE45 | A46 | AE48 | AE48 |
| AF | AF1 | AF2 | AF3 | AF4 | AF5 | AF44 | AF45 | AF46 | AF47 | AF48 |

511-A1

110B

| | 1 | 2 | 3 | 4 | 5 ••• 44 | | 45 | 46 | 47 | 48 |
|---|---|---|---|---|---|---|---|---|---|---|
| A | A1 | A2 | A3 | A4 | A5 | A44 | A45 | A46 | A47 | A48 |
| B | B1 | B2 | B3 | B4 | B5 | B44 | B45 | B46 | B47 | B48 |
| C | C1 | C2 | C3 | C4 | C5 | C44 | C45 | C46 | C47 | C48 |
| ⋮ | | | | | | | | | | |
| Z | Z1 | Z2 | Z3 | Z4 | Z5 | Z44 | Z45 | Z46 | Z47 | Z48 |
| AA | AA1 | AA2 | AA3 | AA4 | AA5 | AA44 | AA45 | AA46 | AA47 | AA48 |
| AB | AB1 | AB2 | AB3 | AB4 | AB5 | AB44 | AB45 | AB46 | AB47 | AB48 |
| AC | AC1 | AC2 | AC3 | AC4 | AC5 | AC44 | AC45 | AC46 | AC47 | AC48 |
| AD | AD1 | AD2 | AD3 | AD4 | AD5 | AD44 | AD45 | AD46 | AD47 | AD48 |
| AE | AE1 | AE2 | AE3 | AE4 | AE5 | AE44 | AE45 | A46 | AE48 | AE48 |
| AF | AF1 | AF2 | AF3 | AF4 | AF5 | AF44 | AF45 | AF46 | AF47 | AF48 |

FIG. 5

ORDERED PICKLIST FOR LIQUID TRANSFER

BACKGROUND

Liquid transfer machines, which may also be referred to as "liquid handlers" are used to perform liquid transfers between a source and a destination. Acoustic liquid transfer machines, also known as "acoustic liquid handlers," are a sub-category of liquid transfer machines used to perform accurate and precise direct, non-contact transfers of small (e.g., nanoliter) volumes of liquids between a source and a destination without using pin tools, pipette tips, or washing. An acoustic liquid transfer machine accomplishes this direct, non-contact transfer of liquid by applying acoustic energy to a liquid source to cause a small amount to liquid to be ejected from the liquid source, through the atmosphere, to a nearby destination where it is captured and retained at the destination by surface tension on the fluid. This process of acoustic liquid transfer may be referred to as Acoustic Droplet Ejection (ADE) technology. Among other applications, acoustic liquid handlers are often used for high-throughput, automated workflows in the fields of pharmaceutical research, biotechnology, and diagnostics. Some non-limiting commercial examples of acoustic liquid transfer machines include the Echo® 650 Liquid Handler and the Echo® 550 Liquid Handler, both available from Labcyte Inc. of San Jose, Calif. (transitioning to Beckman Coulter Life Sciences under the Danaher Life Sciences platform of companies).

BRIEF DESCRIPTION OF DRAWINGS

The accompanying drawings, which are incorporated in and form a part of the Description of Embodiments, illustrate various embodiments of the subject matter and, together with the Description of Embodiments, serve to explain principles of the subject matter discussed below. Unless specifically noted, the drawings referred to in this Brief Description of Drawings should be understood as not being drawn to scale. Herein, like items are labeled with like item numbers.

FIG. 5 shows a top plan view of an example source microplate and an example destination microplate, in accordance with various embodiments.

DESCRIPTION OF EMBODIMENTS

Figure 1:
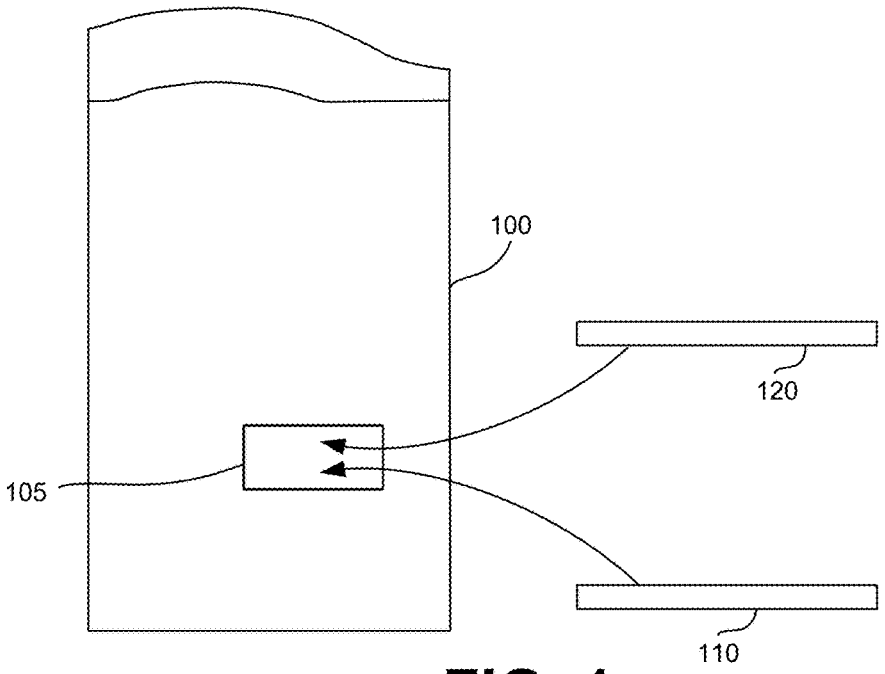
FIG. 1 shows a front side elevational view of an example liquid transfer machine along with a source microplate and a destination microplate which may be utilized by the liquid transfer machine, in accordance with various embodiments.

Reference will now be made in detail to various embodiments of the subject matter, examples of which are illustrated in the accompanying drawings. While various embodiments are discussed herein, it will be understood that they are not intended to limit to these embodiments. On the contrary, the presented embodiments are intended to cover alternatives, modifications and equivalents, which may be included within the spirit and scope the various embodiments as defined by the appended claims. Furthermore, in this Description of Embodiments, numerous specific details are set forth in order to provide a thorough understanding of embodiments of the present subject matter. However, embodiments may be practiced without these specific details. In other instances, well known methods, procedures, components, and circuits have not been described in detail as not to unnecessarily obscure aspects of the described embodiments.

Overview of Discussion

A microplate is a flat plate with multiple depressions, or "wells", for holding liquids; microplates are commonly used in research laboratory and clinical environments. When a microplate is used to hold chemicals or other liquids that will be used in experiments, it can be referred to as a "source microplate." Similarly, when a microplate needs some amount of chemicals transferred to it for use in experiments, it can be referred to as a "destination microplate." Microplates come in different sizes, with different numbers of wells; two commonly-used sizes are microplates with 384 wells and 1536 wells. The wells on a source microplate are referred to as "source wells," while the wells on a destination microplate are referred to as "destination wells." A single "pick" for an acoustic liquid transfer machine specifies the source well from which liquid is to be transferred and the destination well to which the liquid is to be transferred. In some embodiments, depending on the use of the pick, the pick also specifies an amount or volume of liquid to be transferred from the source well to the destination well. The source well and destination well pair in a pick is referred to as a "source/destination pair." A "picklist" is a list of all the source/destination pairs, or picks, that a given experiment requires. The order of the source/destination pairs in the picklist might be random (or not—it's often grouped by compound), but the pairs themselves aren't as they specify specific sources and destinations for liquid transfers from a source microplate to a destination microplate. A picklist may have one, several, hundreds, or even thousands of these source/destination pairs. It takes some amount of time for an acoustic liquid transfer machine to position components for the liquid transfer specified by a pick. For example, prior to conducting a liquid transfer, an acoustic liquid transfer machine positions one or more of a source microplate, a destination microplate, and an acoustic transducer so that a liquid transfer between a particular source/destination pair in a pick can be carried out. This means that for the current source/destination pair the acoustic transducer is beneath the source well and the destination well and the openings of the destination well is positioned, inverted, across from the opening of the source well to facilitate liquid transfer. To conduct the next pick on the picklist, one or more of the source microplate, the destination microplate, and the acoustic transducer are repositioned so the acoustic transducer is repositioned from beneath the current source well to beneath the next source well, and so the openings of the source and destination wells for the next pick are inverted across from one another to facilitate liquid transfer.

As the number of source/destination pairs on a picklist grows the opportunities for inefficiencies can also grow when an inefficient ordering of the picklist causes long repositioning movements between one source/destination pair and a next source/destination pair. When accumulated across an entire picklist with a large number of picks, such inefficiencies may cause a picklist to take significantly longer (e.g., several minutes longer) than if its pics were more efficiently ordered. In a high-throughput workflow in which an acoustic liquid transfer machine is used nearly continuously, such inefficiencies accumulated across a plurality of picklists may become a bottleneck for an acoustic liquid transfer which is conventionally resolved by utilizing additional acoustic liquid transfer machines, at great expense.

Herein, techniques are described in which an initial picklist (or a portion thereof) is processed to create an ordered picklist, which reduces the time for an acoustic liquid transfer machine to perform the liquid transfers to the source/destination pairs on the initial picklist. In one example embodiment, from a positioning of an acoustic liquid transfer machine for a current source/destination pair (i.e., the position of the source microplate, the destination microplate, and the acoustic transducer), distances and/or travel times can be calculated for each component in order to reposition the liquid transfer machine for a one, some, or all of the remaining picks on a picklist. The maximum movement metric (e.g., a movement distance and/or movement time) for these components can be found for each of the picks for which calculations are performed. For example, if moving from the current pick to one of the picks requires holding the source microplate stationary, moving the destination microplate a distance of 3 cm, and moving the acoustic transducer a distance of 5 cm, then the 5 cm distance is noted as the maximum movement metric for repositioning from the current source/destination pair to this source/destination pair. After finding these maximum distances for the remaining picks on a picklist for which calculations are performed, the pick with the shortest maximum distance can be selected to be the next pick. The process can be iterated in the same fashion from the selected next pick to find the pick after the next pick, and so on, until some or all of a picklist is ordered in this fashion. One variation on this process to find the cumulative maximum movement distance or movement time for a sequence of picks (e.g., for a two pick sequence, three pick sequence, etc.), and then select the next pick to be the first pick in the sequence that has the smallest maximum movement distance or movement time of all the calculated pick sequences. Then iterating from this sequence to find a next sequence until some or all of a picklist is ordered in this fashion.

In addition to reducing time spent on a particular picklist, ordering a picklist increases throughput of an acoustic liquid transfer machine to the point where one machine may perform as much work as performed by more than one machine when using un-ordered picklists or using ordered picks that do not employ the ordering techniques described herein. While the techniques herein are described with reference to acoustic liquid transfer machines, it should be appreciated that they may be similarly employed with respect to other liquid transfer machines which utilize picklists to describe liquid sources and destinations. Likewise, examples which reference source microplates and destination microplates may be similarly employed with test tubes, liquid reservoirs, assay plates, and the like which may be utilized with liquid transfer machines.

Discussion begins with a description of notation and nomenclature. Discussion then shifts to description of an example liquid transfer machine and its handling of source and destination microplates to perform liquid transfers to source/destination pairs. Techniques for generating an ordered picklist are discussed. A variety of systems for generating ordered picklists and/or transferring liquids according to ordered picklists are discussed. An example computer system is described which may be utilized to operate an acoustic transfer machine and/or determine an ordered picklist from an initial picklist. Example methods for determining an ordered picklist from an initial picklist and transferring liquids in accordance with an ordered picklist are then described. Finally, an example method of providing an ordered picklist from an initial picklist is described.

Notation and Nomenclature

Some portions of the detailed descriptions which follow are presented in terms of procedures, logic blocks, processes, modules and other symbolic representations of operations on data bits within a computer memory. These descriptions and representations are the means used by those skilled in the data processing arts to most effectively convey the substance of their work to others skilled in the art. In the present application, a procedure, logic block, process, module, or the like, is conceived to be one or more self-consistent procedures or instructions leading to a desired result. The procedures are those requiring physical manipulations of physical quantities. Usually, although not necessarily, these quantities take the form of electrical or magnetic signals capable of being stored, transferred, combined, compared, and otherwise manipulated in an electronic device/component.

It should be borne in mind, however, that all of these and similar terms are to be associated with the appropriate physical quantities and are merely convenient labels applied to these quantities. Unless specifically stated otherwise as apparent from the following discussions, it is appreciated that throughout the description of embodiments, discussions utilizing terms such as "accessing," "obtaining," "calculating," "selecting," "adding," "directing," "controlling," "processing," "receiving," "providing," "commencing," or the like, refer to the actions and processes of an electronic device or component such as: a processor, a controller, a computer system, a memory, a liquid transfer machine or component(s) thereof, or the like, or a combination thereof. The electronic device/component manipulates and transforms data represented as physical (electronic and/or magnetic) quantities within the registers and memories into other data similarly represented as physical quantities within memories or registers or other such information storage, transmission, processing, or display components. Unless specifically stated otherwise as apparent from the following discussions, it is appreciated that throughout the description of embodiments, discussions utilizing terms such as "transferring," "beginning a transfer," "positioning," or the like, refer to actions taken by a liquid transfer machine under direction from a processor or controller.

Embodiments described herein may be discussed in the general context of computer/processor executable instructions residing on some form of non-transitory computer/processor readable storage medium, such as program modules or logic, executed by one or more computers, processors, or other devices. Generally, program modules include routines, programs, objects, components, data structures, etc., that perform particular tasks or implement particular abstract data types. The functionality of the program modules may be combined or distributed as desired in various embodiments.

In the figures, a single block may be described as performing a function or functions; however, in actual practice, the function or functions performed by that block may be performed in a single component or across multiple components, and/or may be performed using hardware, using software, or using a combination of hardware and software. To clearly illustrate this interchangeability of hardware and software, various illustrative components, blocks, modules, circuits, and steps have been described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. Also, the example hardware described herein may include components other than those shown, including well-known components.

The techniques described herein may be implemented in hardware, or a combination of hardware with firmware and/or software, unless specifically described as being implemented in a specific manner. Any features described as modules or components may also be implemented together in an integrated logic device or separately as discrete but interoperable logic devices. If implemented in software, the techniques may be realized at least in part by a non-transitory computer/processor-readable storage medium comprising computer/processor-readable instructions that, when executed, cause a processor and/or other components of a computer or electronic device to perform one or more of the methods described herein. The non-transitory computer/processor-readable data storage medium may form part of a computer program product, which may include packaging materials.

The non-transitory processor readable storage medium (also referred to as a non-transitory computer readable storage medium) may comprise random access memory (RAM) such as synchronous dynamic random access memory (SDRAM), read only memory (ROM), non-volatile random access memory (NVRAM), electrically erasable programmable read-only memory (EEPROM), FLASH memory, compact discs, digital versatile discs, optical storage media, magnetic storage media, hard disk drives, other known storage media, and the like. The techniques additionally, or alternatively, may be realized at least in part by a processor-readable communication medium that carries or communicates code in the form of instructions or data structures and that can be accessed, read, and/or executed by a computer or other processor.

The various illustrative logical blocks, modules, circuits and instructions described in connection with the embodiments disclosed herein may be executed by one or more processors, such as host processor(s) or core(s) thereof, digital signal processors (DSPs), general purpose microprocessors, application specific integrated circuits (ASICs), application specific instruction set processors (ASIPs), field programmable gate arrays (FPGAs), graphics processing unit (GPU), microcontrollers, or other equivalent integrated or discrete logic circuitry. The term "processor" or the term "controller" as used herein may refer to any of the foregoing structures or any other structure suitable for implementation of the techniques described herein. In addition, in some aspects, the functionality described herein may be provided within dedicated software modules or hardware modules configured as described herein. Also, the techniques, or aspects thereof, may be fully implemented in one or more circuits or logic elements. A general purpose processor may be a microprocessor, but in the alternative, the processor may be any conventional processor, controller, microcontroller, or state machine. A processor may also be implemented as a combination of computing devices, e.g., a plurality of microprocessors, one or more microprocessors in conjunction with an ASIC or DSP, or any other such configuration or suitable combination of processors.

Example Liquid Transfer Machine and Microplates

FIG. 1 shows a front side elevational view of an example liquid transfer machine 100 along with a source microplate 110 and a destination microplate 120 which may be utilized by the liquid transfer machine 100, in accordance with various embodiments. In some embodiments, liquid transfer machine 100 is an acoustic liquid transfer machine. Source microplate 110 includes a plurality of reservoirs, which may be called "source wells," for holding stores of liquid to be transferred. Destination microplate 120 includes a plurality of destination sites, which may be called "destination wells," into which liquids may be transferred. As illustrated, source microplate 110 and destination microplate 120 are received via an opening, such as opening 150, into liquid transfer machine 100.

Figure 2:
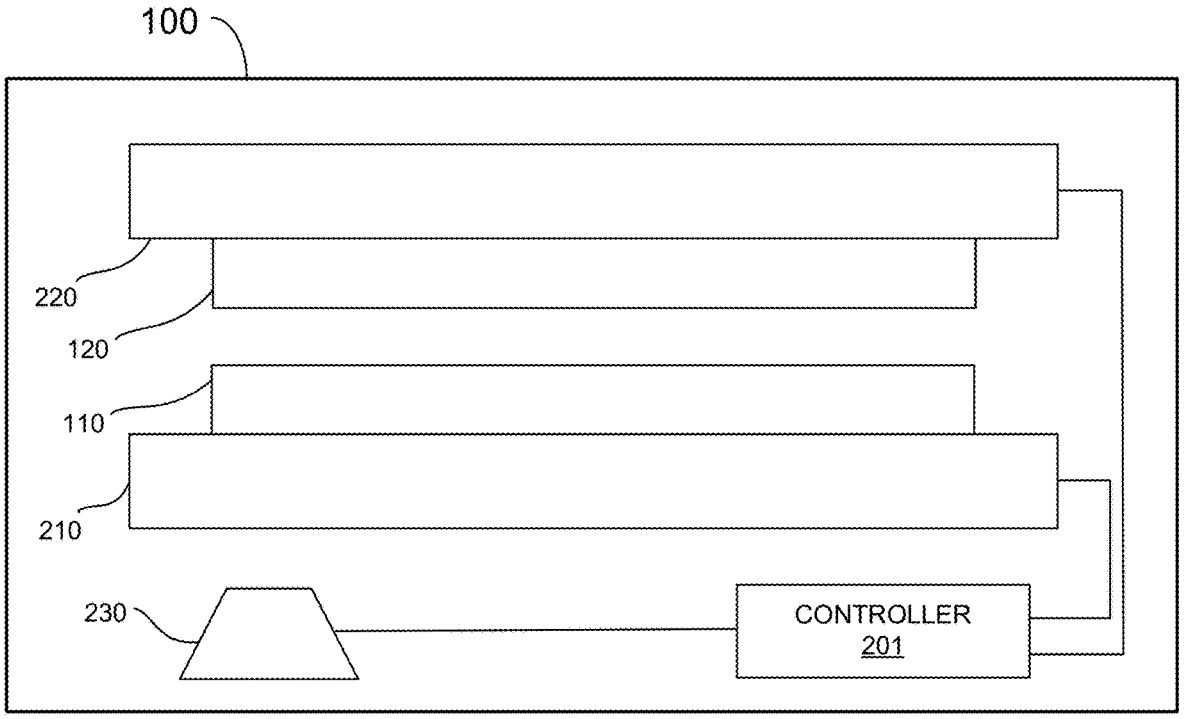
FIG. 2 shows a block diagram of some components of an acoustic liquid transfer machine performing operations with a source microplate and a destination microplate which are shown in side elevational view, in accordance with various embodiments.

FIG. 2 shows a block diagram of some components of an acoustic liquid transfer machine 100 performing operations with a source microplate 110 and a destination microplate 120 which are shown in a side elevational view, in accordance with various embodiments. In the depicted embodiment, liquid transfer machine 100 is an acoustic liquid transfer machine, and includes: a source holding component 210; a destination holding component 220, an acoustic transducer 230, and a controller 201.

Source holding component 210 operates to grip and position source microplate 110 comprising a plurality of source wells. Source holding component 210 may also be referred to as a "source nest," because source microplate 110 nests within it.

Destination holding component 220 operates to grip and position destination microplate 120 comprising a plurality of destination wells. It should be noted that, when performing liquid transfers, destination microplate 120 is held upside-down relative to source microplate 110. Destination holding component 220 may also be referred to as a "destination nest," because destination microplate 120 nests within it. Surface tension and/or other physical properties of a liquid hold it in place on the source microplate while upside down.

Acoustic transducer 230 operates to emit pulses of acoustic energy to cause droplets of liquid of a selected volume to transfer between a source well and a destination well which are represented as a source/destination pair in a picklist. In some embodiments, acoustic transducer 230 emits RF energy which may be in the ultrasonic range. For example, in some embodiments, acoustic transducer 230 comprises an ultrasonic transducer.

Controller 201 may be a microcontroller or other logic or processing device of the types or similar to the types described herein. In some embodiments, controller 201 may additionally include or be coupled with other components such as a memory or may include memory onboard controller 201. Controller 201 operates to direct the two-dimensional movements of one or more of: source holding component 210, destination holding component 220, and acoustic transducer 230. By controlling such two-dimensional positioning, acoustic transducer 230 is positioned beneath a source well of source microplate 110 which is specified in a source/destination pair, while a destination well of destination microplate 120 which is specified in the source/destination pair is positioned above the source well. Additionally, controller 201 directs the timing and emission of acoustic energy from acoustic transducer 230. As will be discussed herein, in various embodiments, controller 201 directs the above described movements and the timing and emission of acoustic energy according to an ordered picklist of source/destination pairs.

Figure 3:
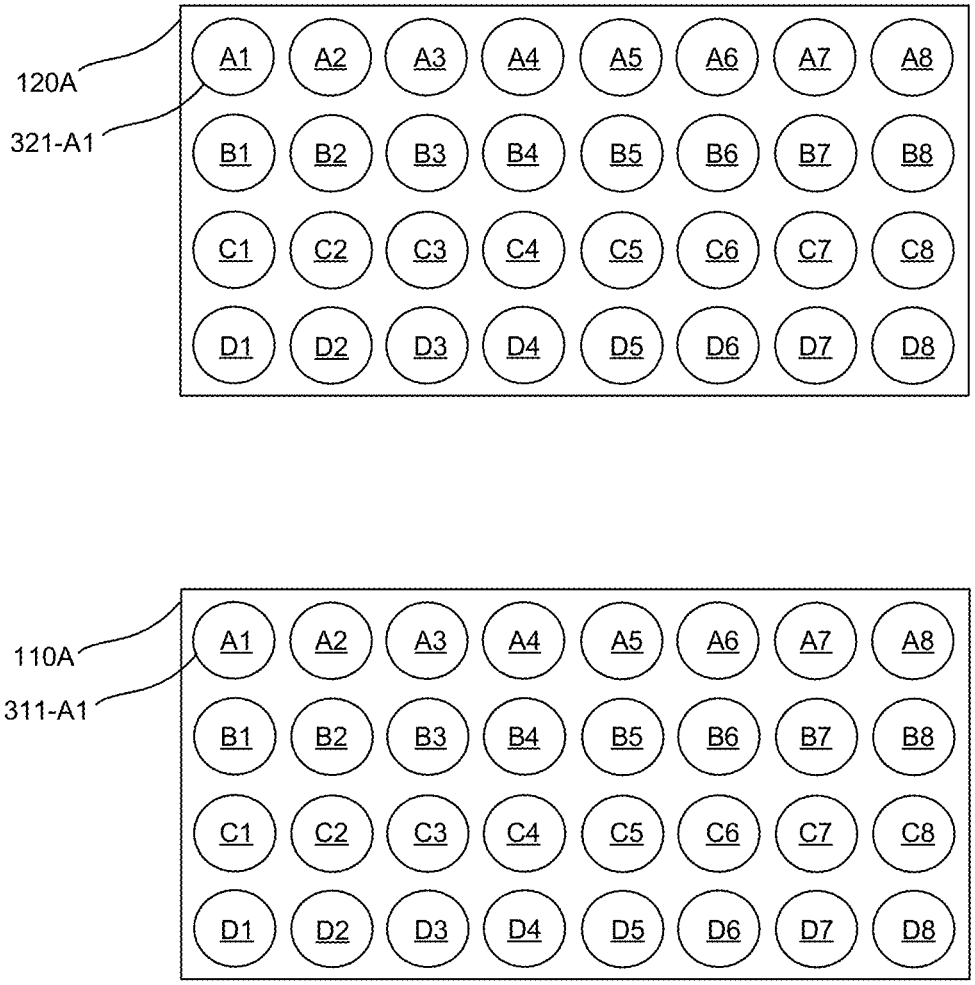
FIG. 3 shows a top plan view of an example source microplate and an example destination microplate, in accordance with various embodiments.

FIG. 3 shows a top plan view of an example source microplate 110A and an example destination microplate 120A, in accordance with various embodiments. Source microplate 110A includes a plurality of source wells 311 (311-A1 through 311-D8). In operation, one or more of the source wells 311 contains liquid which may be transferred to a destination well 321. Destination microplate 120A includes a plurality of destination wells 321 (321-A1 through 321-D8). In operation, in some embodiments, all, some, or none of destination wells 321 may be empty prior to receiving liquid transferred from source microplate 110A. When a destination well is not empty it may contain matter, which may be liquid, to which liquid may be added by transfer from a source well 311. Table 1 shows a short, example picklist which will be used to demonstrate the operation of an acoustic liquid transfer machine in making liquid transfers between source microplate 110A and destination microplate 110B.

Table 1 illustrates an initial picklist of three picks or source/destination pairs for the source microplate 110B and destination microplate 120B illustrated in FIG. 3. The first column specifies the order of a pick in the picklist; the second column specifies the source well from which liquid will be transferred; the third column specifies the destination well to which liquid will be transferred; and the fourth column specifies a volume of liquid to be transferred between the source well and the destination well during the pick.

TABLE 1

Example Initial Picklist

| Source/Destination Pair Order | Source Well | Destination Well | Transfer Volume |
|---|---|---|---|
| 1 | D1 | D8 | 2.5 nL |
| 2 | C5 | D6 | 5.0 nL |
| 3 | B1 | B7 | 2.5 nL |

In FIGS. 4A-4F some aspects of an acoustic liquid transfer machine will be illustrated and described carrying out the three picks in the picklist of Table 1. FIGS. 4A-4F will illustrate and describe the transfer of liquids between the source microplate and destination microplate of FIG. 3 by performing source/destination pair picks in the order specified by column 1 of Table 1.

Figure 4A:
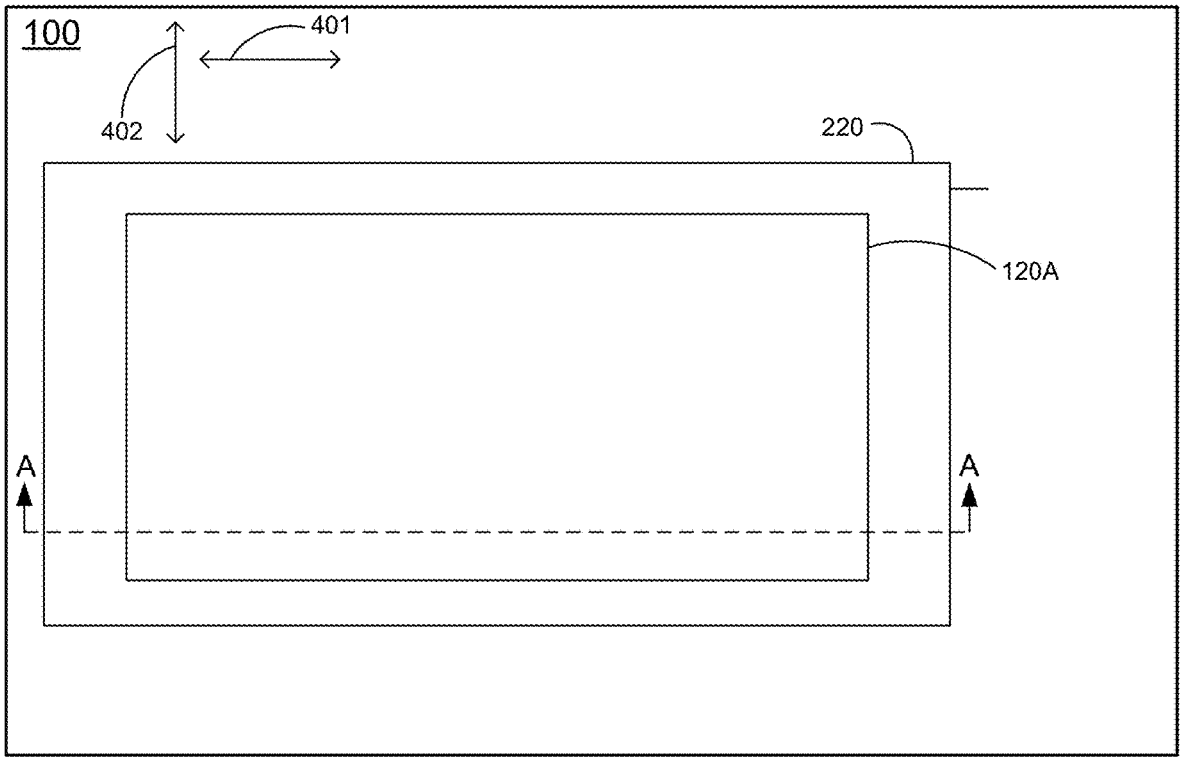
FIG. 4A shows a top plan view of the example source microplate and the example destination microplate of FIG. 3 being utilized within an acoustic liquid transfer machine, in accordance with various embodiments.
Figure 4B:
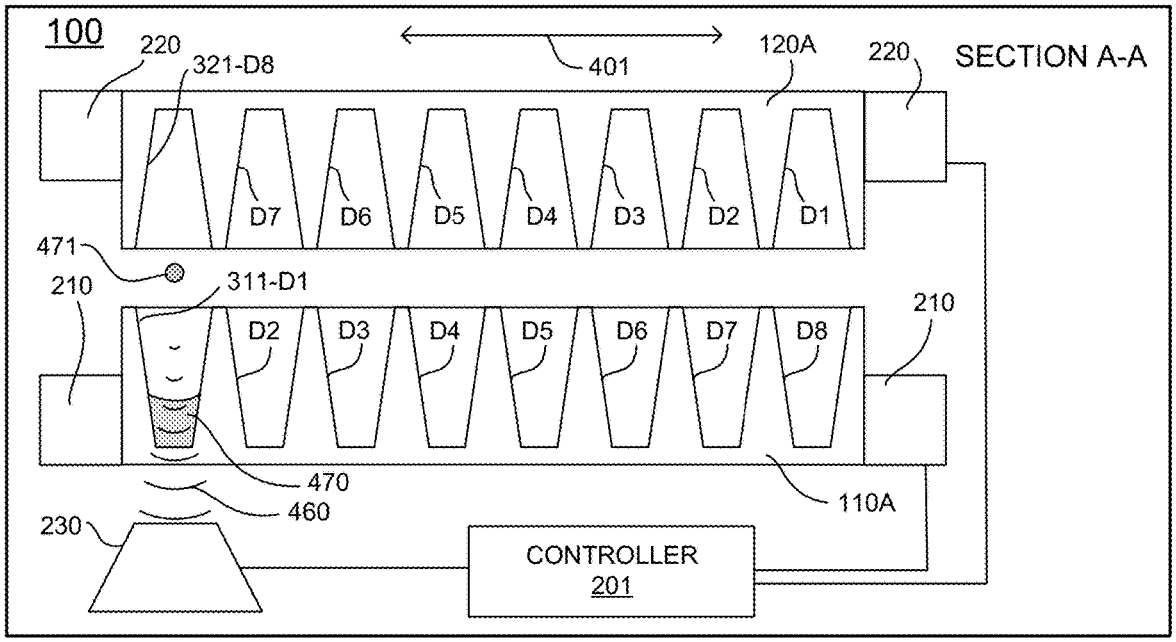
FIG. 4B illustrates a side sectional view of the example source microplate and the example destination microplate of FIGS. 3 and 4A being utilized within an acoustic liquid transfer machine, in accordance with various embodiments.

FIGS. 4A and 4B illustrate and describe positioning of certain components of an acoustic liquid transfer machine to transfer of liquid between source destination pair D1, D8 in accordance with the first source/destination pair pick in the picklist order of Table 1. FIG. 4A shows a top plan view of example source microplate 110A and example destination microplate 120A of FIG. 3 being utilized within an acoustic liquid transfer machine 100, in accordance with various embodiments. Because of the alignment of the microplates, only the top side of destination microplate 120A and destination holding component 220 are visible. The positioning of components of FIG. 4A can be assumed to be shown by FIG. 2, where destination microplate 120A is inverted over source microplate 110A, thereby positioning well 321-D8 above source well 311-D1, and acoustic transducer 230 is below source well 311-D1.

Directional arrow 401 represents a first axis or dimension in which one or more of source holding component 210, destination holding component 220, and acoustic transducer 230 (not visible) may be directed to move by a controller 201 (not visible). Directional arrow 402 represents a second axis or dimension in which one or more of source holding component 210, destination holding component 220, and acoustic transducer 230 may be directed to move by controller 201. It should be appreciated that, in some embodiments, one or more of source holding component 210, destination holding component 220, and acoustic transducer 230 may be directed to move diagonally within the planes defined by directional arrows 401 and 402. However, for purposes of providing a simplified example, movements of one or more of source holding component 210, destination holding component 220, and acoustic transducer 230 will be described as being along one or both of the axes represented by directional arrows 401 and 402. Section line A-A defines the location and direction of a sectional view illustrated in FIG. 4B.

FIG. 4B illustrates what happens when an acoustic liquid transfer machine is operating—ultrasonic waves from an acoustic transducer cause a precisely-sized droplet of liquid to be ejected from the source well and up into the destination well according to the first source/destination pair pick on the picklist of table 1. FIG. 4B illustrates a side sectional view A-A of the example source microplate 110A and the example destination microplate 120A of FIGS. 3 and 4B being utilized within an acoustic liquid transfer machine 100, in accordance with various embodiments.

In the depicted embodiment, the source/destination pair 311-D1/321-D8 from the picklist of Table 1 has caused controller 201 to position acoustic transducer 230 beneath source well 311-C1 of source microplate 110A and to position destination well 321-D8 of destination microplate 120A above source well 311-D1. Acoustic transducer 230 is depicted emitting acoustic energy 460 which causes droplet 471 to be ejected toward destination well 321-D8 from liquid 470 in source well 311-D1.

Figure 4C:
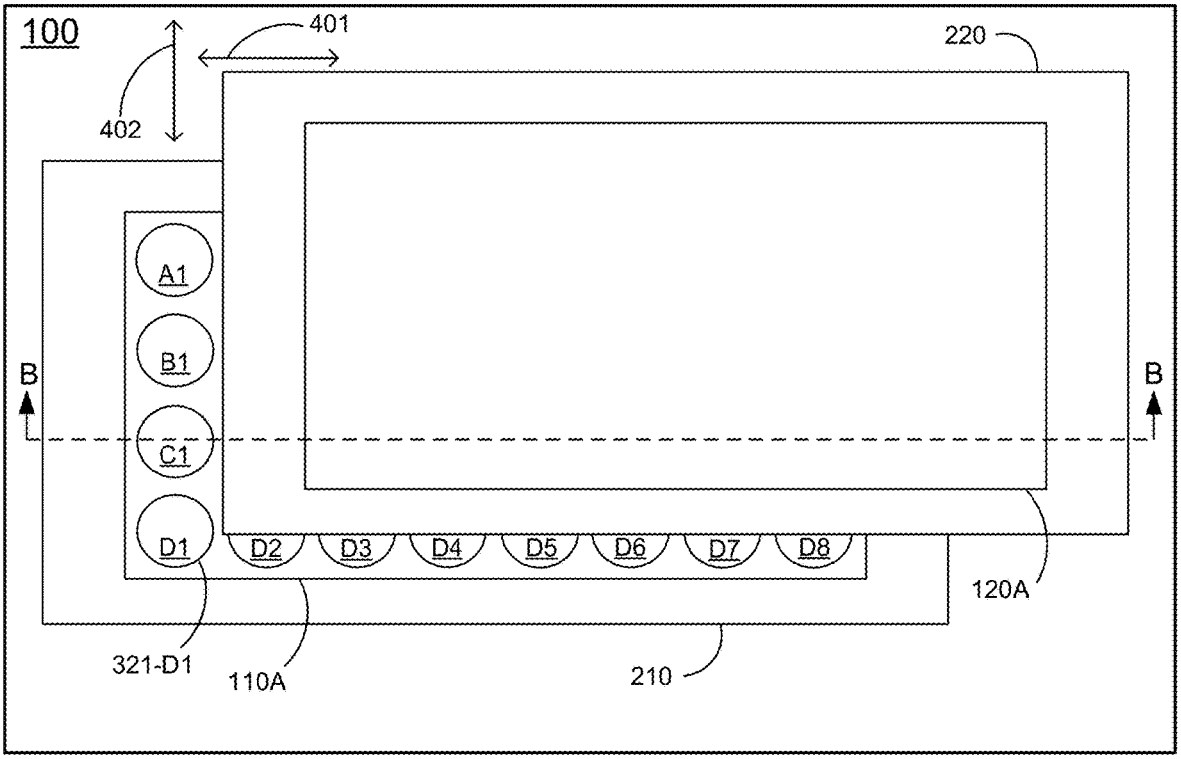
FIG. 4C shows a top plan view of the example source microplate and the example destination microplate of FIGS. 4A and 4B being utilized within an acoustic liquid transfer machine, in accordance with various embodiments.
Figure 4D:
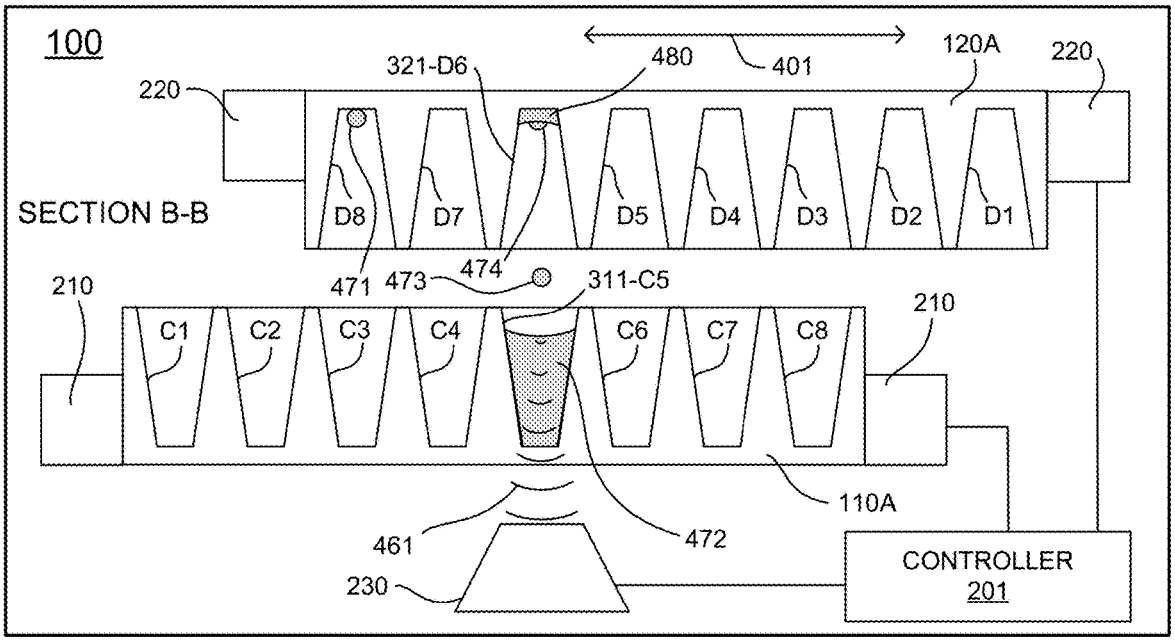
FIG. 4D illustrates a side sectional view of the example source microplate and the example destination microplate of FIGS. 4A and 4B being utilized within an acoustic liquid transfer machine, in accordance with various embodiments.

FIGS. 4C and 4D illustrate and describe positioning of certain components of an acoustic liquid transfer machine to transfer of liquid between source destination pair C5, D6 in accordance with the second pick in the picklist order of Table 1. FIG. 4C shows a top plan view of the example source microplate 110A and the example destination microplate 120A of FIG. 3 being utilized within an acoustic liquid transfer machine 100, in accordance with various embodiments. For purposes of this example and not of limitation, the previous positioning of components of FIG. 4C can be assumed to be shown by FIGS. 2, 4A, and 4B, where destination well 321-D8 is positioned above source well 311-D1, and acoustic transducer 230 is below source well 311-D1. Section line B-B defines the location and direction of a sectional view illustrated in FIG. 4D.

FIG. 4D illustrates what happens when an acoustic liquid transfer machine is operating—ultrasonic waves from an acoustic transducer cause a precisely-sized droplet of liquid to be ejected from the source well and up into the destination well according to the second source/destination pair pick on the picklist of Table 1. FIG. 4D illustrates a side sectional view B-B of the example source microplate 110A and the example destination microplate 120A being utilized within an acoustic liquid transfer machine 100, in accordance with various embodiments.

In the depicted embodiment, a source/destination pair 311-C5/321-D6 from the picklist of Table 1 has caused controller 201 to position acoustic transducer 230 beneath source well 311-C5 of source microplate 110A and to position destination well 321-D6 of destination microplate 120A above source well 311-C5. Acoustic transducer 230 is depicted emitting acoustic energy 461 which causes droplet 473 to be ejected toward destination well 321-D6 from liquid 472 in source well 311-C5. Droplet 474 represents a previously transferred droplet of liquid, while liquid 480 (when present) represents a preexisting liquid in destination well 321-D6 to which droplets 472 and 471 are added.

In some embodiments, repositioning from the orientation of components shown in FIGS. 4A and 4B to the orientation of components shown in FIGS. 4C and 4D is accomplished by controller 201 directing source holding component 210 to remain still while directing both of acoustic transducer 230 and directing destination holding component 220 to move relative to source holding component 210. To reposition from the orientation of components shown in FIGS. 4A and 4B to the orientation of components shown in FIGS. 4C and 4D: source microplate 110A has been held in place; destination microplate 120A has been moved two wells rightward on axis 401 and one well upward/into the page on axis 402; and acoustic transducer 320 has been moved four well rightward on axis 401 and one well upward/inward to the page on axis 402. When movement of a distance of center-to-center of "one well" on either axis is considered a unit of movement, then destination microplate 120A has moved three units, while acoustic transducer 320 has moved five units. Thus, of two moving components, acoustic transducer 230 has moved farther.

In an embodiment where steady state travel speeds, ramp-up travel speed (i.e., a controlled speeding up to the steady state speed), ramp-down travel speeds (i.e., a controlled slowing down from the steady state speed to a stop), settling time (which may be used to ensure liquids have settled or components have fully stopped moving prior to a transfer) after arriving at a destination, and/or other factors regarding movement are similar, it also takes longer for acoustic transducer 230 to move from the position illustrated in FIG. 4B to the position illustrated in FIG. 4D than it does for destination holding component 220 to move into reposition. When speed of movement and other factors (ramp up speed, ramp down speed, settling time, etc.) of destination holding component 220 and acoustic transducer 320 are the same or within some negligible tolerance such as a few percent, then units moved is a gauge not only of distance but time to reposition. Accordingly, the controlling factor for repositioning from pick 1 to pick 2 of Table 1 is the distance moved by acoustic transducer 320 because it is the farthest repositioning movement between the two picks, and thus has the largest movement metric for this source/destination pair.

Thus, in various embodiments where movement factors are similar between moving components, the component moving the farthest controls a movement metric describing the amount of time taken to reposition from a current source/destination pair to a next source destination pair. In such embodiments, the movement metric may be expressed as a distance due to like movement factors of different moving components being similar (e.g., with a predetermined percentage such as a few percent) or identical. This movement metric may be calculated by controller 201 or another processor or computing system.

In an embodiment where one or more of steady state travel speeds, ramp-up travel speeds, ramp-down travel speeds, settling time, and/or other factors regarding movement are not similar, it may take longer for destination holding component 220 to move from the position illustrated in FIG. 4B to the position illustrated in FIG. 4D than it does for acoustic transducer 230. In various other embodiments of this type, where movement factors are not similar between moving components, one or more of these movement factors may be taken into account to determine which moving component controls (dominates) a movement metric describing the time required to reposition from a current source/destination pair to a next source destination pair. In such embodiments, the movement metric may be expressed as a timespan due to like movement factors (e.g., settling time) of different moving components being unequal. This movement metric may be calculated by controller 201 or another processor or computing system.

In various embodiments, a movement metric for repositioning moving components of acoustic liquid transfer machine 100 from a current source/destination pair to a next source/destination pair may be associated with at least one of: a movement of acoustic transducer 230 relative to source holding component 210; a movement of acoustic transducer 230 relative to destination holding component 220; a movement of destination holding component 220 relative to source holding component 210; a movement of destination holding component 220 relative to acoustic transducer 230; a movement of source holding component 210 relative to destination holding component 220; and a movement of source holding component 210 relative to acoustic transducer 230.

Figure 4E:
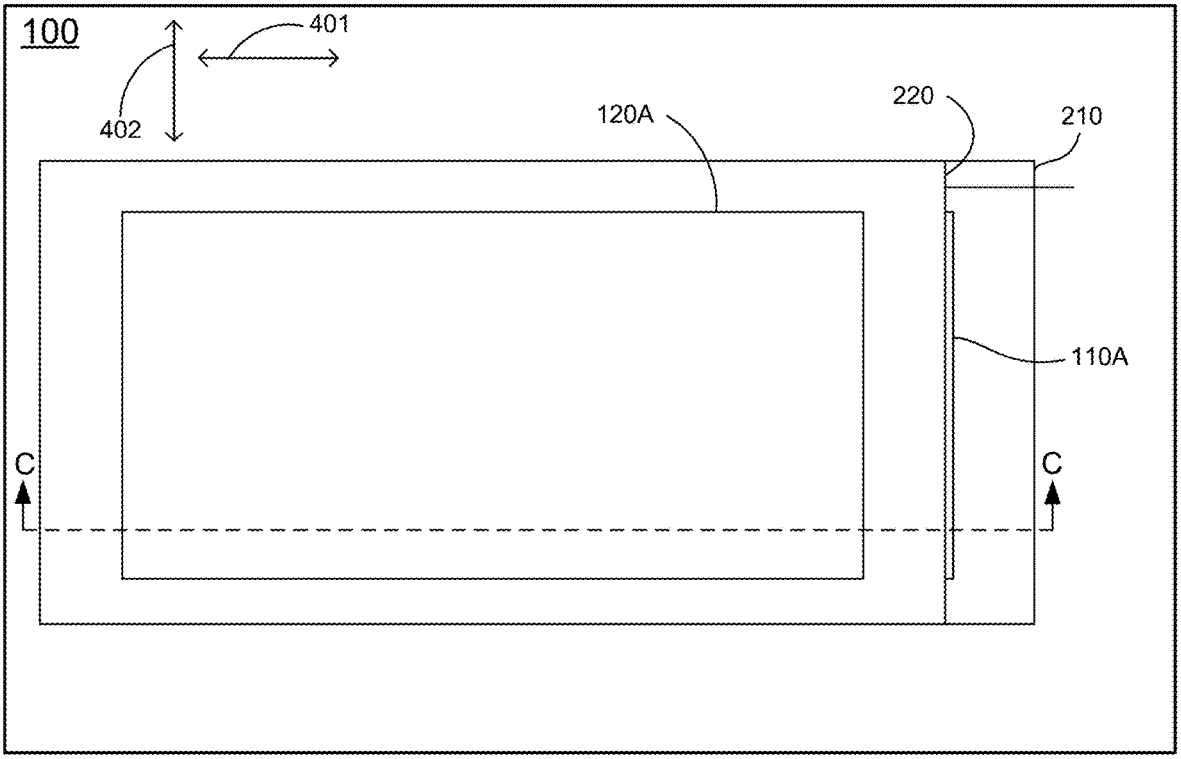
FIG. 4E shows a top plan view of the example source microplate and the example destination microplate of FIGS. 4A and 4B being utilized within an acoustic liquid transfer machine, in accordance with various embodiments.
Figure 4F:
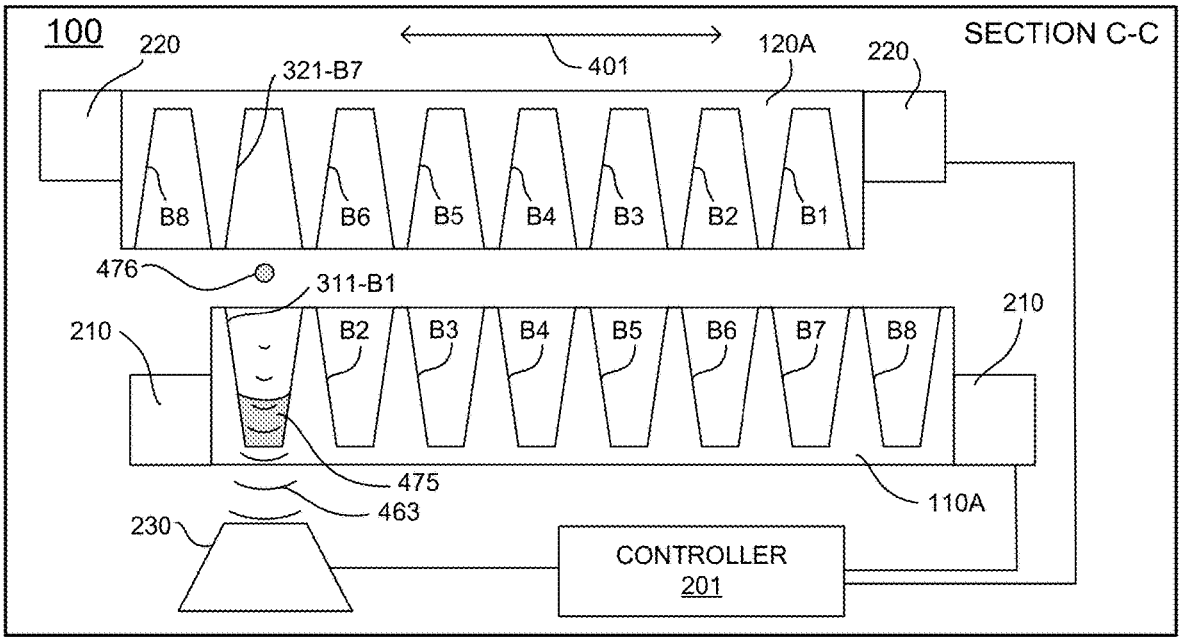
FIG. 4F illustrates a side sectional view of the example source microplate and the example destination microplate of FIGS. 4A and 4B being utilized within an acoustic liquid transfer machine, in accordance with various embodiments.

FIGS. 4E and 4F illustrate and describe positioning of certain components of an acoustic liquid transfer machine to transfer of liquid between source destination pair B1, B7 in accordance with the third source/destination pair pick in the picklist order of Table 1. FIG. 4E shows a top plan view of the example source microplate 110A and the example destination microplate 120A of FIG. 3 being utilized within an acoustic liquid transfer machine 100, in accordance with various embodiments. Section line C-C defines the location and direction of a sectional view illustrated in FIG. 4F.

FIG. 4F illustrates what happens when an acoustic liquid transfer machine is operating—ultrasonic waves from an acoustic transducer cause a precisely-sized droplet of liquid to be ejected from the source well and up into the destination well according to the third source/destination pair pick on the picklist of Table 1. FIG. 4F illustrates a side sectional view C-C of the example source microplate 110A and the example destination microplate 120A being utilized within an acoustic liquid transfer machine 100, in accordance with various embodiments.

In the depicted embodiment, a source/destination pair 311-B1/321-B7 from the picklist of Table 1 has caused controller 201 to position acoustic transducer 230 beneath source well 311-B1 of source microplate 110A and to position destination well 321-B7 of destination microplate 120A above source well 311-B1. Acoustic transducer 230 is depicted emitting acoustic energy 463 which causes droplet 476 to be ejected toward destination well 321-B7 from liquid 475 in source well 311-B1.

In some embodiments, repositioning from the orientation of components shown in FIGS. 4C and 4D to the orientation of components shown in FIGS. 4E and 4F is accomplished by controller 201 directing source holding component 210 to remain still while directing both of acoustic transducer 230 and directing destination holding component 220 to move relative to source holding component 210. To reposition from the orientation of components shown in FIGS. 4C and 4D to the orientation of components shown in FIGS. 4E and 4F: source microplate 110A has been held in place; destination microplate 120A has been moved three wells leftward on axis 401 and one well downward/away from the page on axis 402; and acoustic transducer 320 has been moved four wells leftward on axis 401 and one well downward/outward from the page on axis 402. When movement of a distance of center-to-center of "one well" on either axis is considered a unit of movement, then destination microplate 120A has moved four units, while acoustic transducer 320 has moved five units. Accordingly, the controlling factor for repositioning from pick 2 to pick 3 of Table 1 is the distance moved by acoustic transducer 320 because it is the farthest repositioning movement between the two picks, and thus has the largest movement metric for this source/destination pair.

In moving from pick 1 of Table 1 to pick 2 and then to pick 3 the maximum movement metric for repositioning from pick 1 to pick 2 is five units, and the maximum movement metric for moving from pick 2 to pick 3 is also five units. Adding these maximums up for each pick gives a total of ten units of distance/time to start from pick 1 and move through pick 3.

As will be demonstrated with the discussion of Equation 1 and Equation 2, this maximum movement metric between picks and the cumulative maximum movement metric for an entire picklist can often be reduced by ordering the picks in one of the manners described herein where maximum movements to reposition for the next pick(s) are calculated and then the pick list is ordered to select for a shortest maximum movement from a current pick to the next pick, and so forth. Equation 1 represents an example equation which can be used to calculate a movement metric, $c_{i,j}$, for repositioning moving components of an acoustic liquid transfer machine 100 from a current source/destination pair to another source/destination pair.

$$c_{i,j}=\max(\|s_j-s_i\|,\|(s_j-s_i)-(d_j-d_i)\|) \quad \text{Eq. 1}$$

In Equation 1: $c_{1,j}=c_{i,1}=0$; j=1, . . . , n; and i=1, . . . , n. i represents an initial source/destination pair, while j represents a potential future source/destination pair. $s_i$ represents the beginning position of a first moving component, such as acoustic transducer 230, while at a current source destination pair. $s_j$ represents a potential future position of this first moving component after being repositioned to another source/destination pair. $\|s_i-s_j\|$ defines a metric for the cost associated with repositioning the first moving component from the initial source/destination pair (i) to the potential future source/destination pair (j). The $\|s_i-s_j\|$ metric may be a "cost" in distance moved or a "cost" in timespan to make the move. $d_i$ represents the beginning position of a second moving component, such as destination holding component 220, while at a current source destination pair. $d_j$ represents the destination position of this first moving component after being repositioned to another source/destination pair. $\|(s_i-s_j)-(d_i-d_j)\|$ defines a metric for the cost associated with repositioning the second moving component from the initial source/destination pair (i) to the potential future source/destination pair (j). The $\|(s_i-s_j)-(d_i-d_j)\|$ metric may be a "cost" in distance moved or a "cost" timespan to make the move. The maximum of either $\|(s_i-s_j)-(d_i-d_j)\|$ or $\|s_i-s_j\|$ is found and becomes the movement metric for moving from the initial source/destination pair to a potential future source/destination pair. Although, Equation 1 is written for two moving components, it can similarly be written for three moving components in a case where source holding component 210 also moves when repositioning between source/destination pairs. When a plurality of source/destination pairs on an initial picklist have not yet been visited by acoustic liquid transfer machine 100, then some or all of these unvisited source/destination pairs may be evaluated to determine an associated movement metric $c_{i,j}$ for repositioning from the current source/destination pair. After such evaluation, these associated movement metrics are used to find an optimal next source/destination pair. This procedure could include methods such as sorting the movement metrics to find the smallest, and the source/destination pair associated with this movement metric is chosen as the next source/destination pair. This next source/destination pair can be added to an ordered picklist. A subsequent source/destination pairs on the ordered picklist can then be determined by using the next source/destination pair as the starting location then repeating this procedure outlined above with Equation 1 for some or all of the remaining unvisited source/destination pairs on the initial picklist which have yet to be visited or added to the ordered picklist. The ordered picklist can be expanded in this fashion until as many source/destination pairs as desired are added or the source/destination pairs on the initial picklist are exhausted.

Application of Equation 1 to the picklist of Table 1, with the presumption of an initial source destination pair D1, D8, results in an ordered picklist shown in Table 2. In the ordered picklist of Table 2, the cumulative maximum travel to perform the three picks has been reduced by three unit versus performing liquid transfers in the order specified by the initial picklist. For example, the maximum movement metric for repositioning from source/destination pair D1, D8 to source/destination pair B1, B7 is two; while the maximum movement metric for repositioning from source/destination pair B1, B7 to source destination pair C5, D6 is five units. The cumulative maximum travel for the ordered picklist of Table 2 is seven units, versus ten units for the picklist of Table 1.

TABLE 2

Example Ordered Picklist

| Source/Destination Pair Order | Source Well | Destination Well | Transfer Volume |
|---|---|---|---|
| 1 | D1 | D8 | 2.5 nL |
| 2 | B1 | B7 | 2.5 nL |
| 3 | C5 | D6 | 5.0 nL |

Equation 2 represents another example equation which can be used to calculate a movement metric, $c_{i,j}$, for repositioning moving components of an acoustic liquid transfer machine 100 from a current source/destination pair to another source/destination pair.

$$c_{i,j}=\max(\|s_i-s_j\|,\|d_i-d_j\|) \quad \text{Eq. 2}$$

The terms in Equation 2 have the same meanings as those in Equation 1, but the manner in which movement metric $c_{i,j}$ is calculated is slightly different. An ordered picklist can be created by applying Equation 2, in a repetitive fashion, in the same manner as described above with respect to source/destination pairs in an initial picklist.

FIG. 5 shows a top plan view of an example source microplate 110B and an example destination microplate 120B, in accordance with various embodiments. Source microplate 110A includes a plurality of source wells 511 (511-A1 through 511-AF48) for a total of 1536 source wells, arranged in a grid of 48 columns by 32 rows. In operation, one or more of the source wells 511 contains liquid which may be transferred to a destination well 521. Destination microplate 120B includes a plurality of destination wells 521 (521-A1 through 521-AF48) for a total of 1536 destination wells. In operation, in some embodiments, all, some, or none of destination wells 521 may be empty prior to receiving liquid transferred from source microplate 110A. When a destination well is not empty it may contain matter, which may be liquid, to which liquid may be added by transfer from a source well 511.

Table 3 illustrates an initial picklist of source/destination pairs for the source microplate 110B and destination microplate 120B illustrated in FIG. 5. This initial picklist lists all of the source destination pairs utilized in a(n) experiment(s) with a source microplate and a destination microplate. The order of the picks in the initial picklist may be random or not, but the source/destination pairs themselves are not random—that is, they specify certain liquid transfers for the experiment(s).

TABLE 3

Example Initial Picklist

| Source/Destination Pair Order | Source Well | Destination Well | Transfer Volume |
|---|---|---|---|
| 1 | Q07 | I02 | 2.5 nL |
| 2 | U13 | AA39 | 2.5 nL |
| 3 | W47 | O14 | 2.5 nL |

TABLE 3-continued

Example Initial Picklist

| Source/Destination Pair Order | Source Well | Destination Well | Transfer Volume |
|---|---|---|---|
| 4 | AA48 | K34 | 2.5 nL |
| 5 | J25 | T17 | 2.5 nL |
| 6 | AE46 | T29 | 2.5 nL |
| 7 | F25 | L20 | 2.5 nL |
| 8 | AB45 | P23 | 2.5 nL |
| 9 | D41 | O26 | 2.5 nL |
| 10 | Q10 | N32 | 2.5 nL |
| 11 | AF11 | O41 | 2.5 nL |
| 12 | AF44 | G06 | 2.5 nL |

For purposes of example, an initial positioning of source holding component 210 and destination holding component 220 of acoustic liquid transfer machine 100 may be such that source well 511-A1 and destination well 521-A48 are aligned and acoustic transducer 230 is beneath source well 511-A1.

An ordered picklist can be created from this initial picklist by applying Equation 1 or Equation 2, or a like equation that similarly attempts to calculate movement metrics between a current source/destination pair and a number of future pairs that also have to be visited on a picklist, and can be used to identify a more optimal next pick. In short, Table 4 illustrates an ordered picklist created by application of Equation 2 to the initial picklist of Table 3, where the movement metric calculated is the distance between source/destination pairs.

TABLE 4

Example Ordered Picklist

| Source/Destination Pair Order | Source Well | Destination Well | Transfer Volume |
|---|---|---|---|
| 1 | Q07 | I02 | 2.5 nL |
| 2 | Q10 | N32 | 2.5 nL |
| 3 | U13 | AA39 | 2.5 nL |
| 4 | J25 | T17 | 2.5 nL |
| 5 | F25 | L20 | 2.5 nL |
| 6 | D41 | O26 | 2.5 nL |
| 7 | W47 | O14 | 2.5 nL |
| 8 | AB45 | P23 | 2.5 nL |
| 9 | AE46 | T29 | 2.5 nL |
| 10 | AA48 | K34 | 2.5 nL |
| 11 | AF44 | G06 | 2.5 nL |
| 12 | AF11 | O41 | 2.5 nL |

Table 5 illustrates the initial picklist of Table 1 sorted by closest next source well for the source/destination pairs. Table 5 is shown for comparison purposes and does not use the Equation 1, Equation 2, or a like equation. Instead, future/remaining picks on the picklist are evaluated and the closest source well of these picks to the source well of the current source/destination pair is located and its source/destination pair is chosen for the next pick.

TABLE 5

Example Source Well Sorted Picklist

| Source/Destination Pair Order | Source Well | Destination Well | Transfer Volume |
|---|---|---|---|
| 1 | AA48 | K34 | 2.5 nL |
| 2 | AB45 | P23 | 2.5 nL |
| 3 | AE46 | T29 | 2.5 nL |

TABLE 5-continued

| Example Source Well Sorted Picklist | | | |
|---|---|---|---|
| Source/Destination Pair Order | Source Well | Destination Well | Transfer Volume |
| 4 | AF11 | O41 | 2.5 nL |
| 5 | AF44 | G06 | 2.5 nL |
| 6 | D41 | O26 | 2.5 nL |
| 7 | F25 | L20 | 2.5 nL |
| 8 | J25 | T17 | 2.5 nL |
| 9 | Q07 | I02 | 2.5 nL |
| 10 | Q10 | N32 | 2.5 nL |
| 11 | U13 | AA39 | 2.5 nL |
| 12 | W47 | O14 | 2.5 nL |

Table 6 illustrates the initial picklist of Table 1 sorted by closest next destination well for the source/destination pairs. Table 6 is shown for comparison purposes and does not use the Equation 1, Equation 2, or a like equation. Instead, future/remaining picks on the picklist are evaluated and the closest destination well of these picks to the destination well of the current source/destination pair is located and its source/destination pair is chosen for the next pick.

TABLE 6

| Example Destination Well Sorted Picklist | | | |
|---|---|---|---|
| Source/Destination Pair Order | Source Well | Destination Well | Transfer Volume |
| 1 | U13 | AA39 | 2.5 nL |
| 2 | AF44 | G06 | 2.5 nL |
| 3 | Q07 | I02 | 2.5 nL |
| 4 | AA48 | K34 | 2.5 nL |
| 5 | F25 | L20 | 2.5 nL |
| 6 | Q10 | N32 | 2.5 nL |
| 7 | W47 | O14 | 2.5 nL |
| 8 | D41 | O26 | 2.5 nL |
| 9 | AF11 | O41 | 2.5 nL |
| 10 | AB45 | P23 | 2.5 nL |
| 11 | J25 | T17 | 2.5 nL |
| 12 | AE46 | T29 | 2.5 nL |

Table 7 describes the cumulative distance traveled by moving components (e.g., acoustic transducer 230 and destination holding component 220) in order to perform all 12 picks according to the source/destination pair order of each of the picklists in Tables 3-6. As can be seen, the ordered picklist of Table 4 required the least distance traveled, and thus the least time to perform the liquid transfers for all of the the source/destination pairs.

TABLE 7

| Cumulative Distance Traveled by Different Picklist Orderings | |
|---|---|
| Picklist | Distance Traveled (units) |
| Initial Pick | 360.941 |
| Destination Sort | 418.216 |
| Source Sort | 275.498 |
| Ordered Picklist | 200.572 |

Although the picklists illustrated with respect to Tables 3-6 utilize source and destination microplates with 1536 wells each, the same techniques for generating an ordered picklist may be utilized with microplates having a greater or lesser number of wells. Likewise, the same techniques for generating an ordered picklist may be utilized with a source microplate which has a different number of wells than a destination microplate.

Consider an example, where an initial picklist is supplied to liquid transfer machine 100 of FIG. 1 via peripheral computer readable media (e.g., a universal serial bus flash memory drive, a connected hard disk drive, etc.). In some embodiments, liquid transfer machine 100 or components thereof (such as controller 201) may determine an ordered picklist from the supplied initial picklist in any of the manners described herein with reference to Equation 1, Equation 2, or the like.

Figure 6:
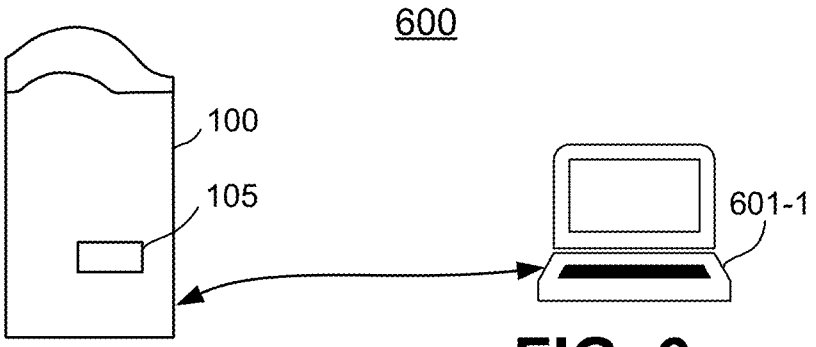
FIG. 6 illustrates a liquid transfer system, in accordance with various embodiments.

FIG. 6 illustrates a liquid transfer system 600, in accordance with various embodiments. System 600, in some embodiments, comprises a liquid transfer machine 100 and a computer system 601-1 which are communicatively coupled locally wirelessly, by wireline (e.g., a serial cable), or via a local network. Liquid transfer machine 100 may be an acoustic liquid transfer machine. Computer system 601-1 may be any suitable type of computer, including, but not limited to: a notebook computer, a laptop computer, a desktop computer, a server computer, smart phone, a tablet computer, a virtual computer implemented on underlying hardware, etc. According to some embodiments, computer system 601-1 may supply an initial picklist to liquid transfer machine 100 or permit liquid transfer machine 100 to access the initial picklist stored on computer system 601-1.

In some embodiments, liquid transfer machine 100 or components thereof (such as controller 201) may determine an ordered picklist from a supplied/accessed initial picklist in any of the manners described herein with reference to Equation 1, Equation 2, or the like.

In some embodiments, computer 601-1 or components thereof may determine an ordered picklist from an initial picklist in any of the manners described herein with reference to Equation 1, Equation 2, or the like. Computer system 601-1 may then supply this ordered picklist to liquid transfer machine 100 or permit liquid transfer machine 100 to access this ordered picklist stored on computer system 601-1.

Figure 7:
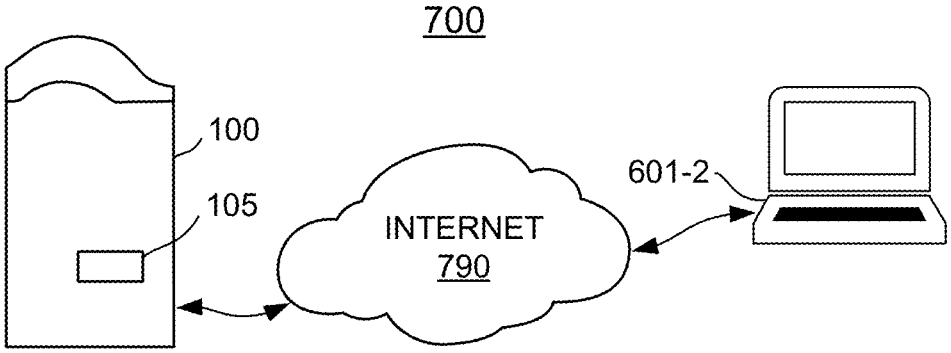
FIG. 7 illustrates a liquid transfer system, in accordance with various embodiments.

FIG. 7 illustrates a liquid transfer system 700, in accordance with various embodiments. System 700, in some embodiments, comprises a liquid transfer machine 100 and a remotely located computer system 601-2 which are communicatively coupled via the Internet 790. Liquid transfer machine 100 may be an acoustic liquid transfer machine. Computer system 601-2 may be any suitable type of computer, including, but not limited to: a notebook computer, a laptop computer, a desktop computer, a server computer, a virtual computer implemented on underlying hardware, etc. According to some embodiments, computer system 601-2 may supply an initial picklist to liquid transfer machine 100 or permit liquid transfer machine 100 to access the initial picklist stored on computer system 601-2.

In some embodiments, liquid transfer machine 100 or components thereof (such as controller 201) may determine an ordered picklist from a supplied/accessed initial picklist in any of the manners described herein with reference to Equation 1, Equation 2, or the like.

In some embodiments, computer 601-2 or components thereof may determine an ordered picklist from an initial picklist in any of the manners described herein with reference to Equation 1, Equation 2, or the like. Computer system 601-2 may then supply this ordered picklist to liquid transfer machine 100 or permit liquid transfer machine 100 to access this ordered picklist stored on computer system 601-2.

Figure 8:
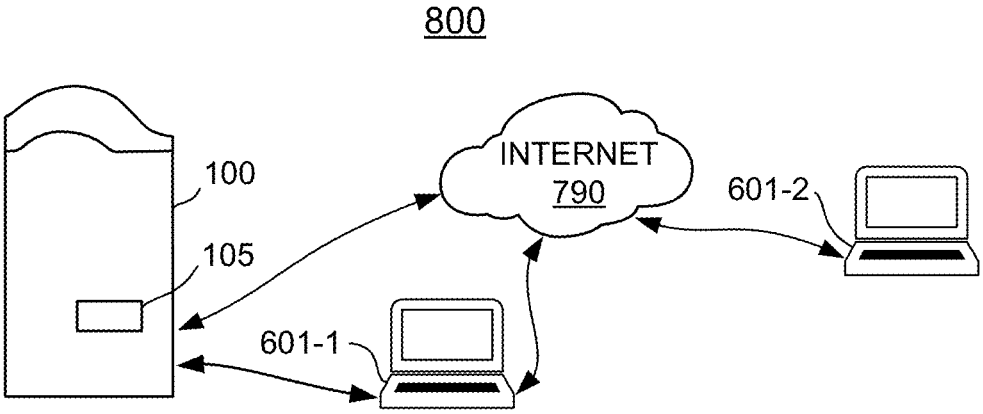
FIG. 8 illustrates a liquid transfer system, in accordance with various embodiments.

FIG. 8 illustrates a liquid transfer system 800, in accordance with various embodiments. System 800, in some embodiments, comprises a liquid transfer machine 100, and a computer system 601-1, and a computer system 601-2. Liquid transfer machine 100 and a computer system 601-1 are communicatively coupled and local to one another. Computer system 601-2 is remote from computer system 601-1 and from liquid transfer machine 100 and may be communicatively coupled to one or both via the Internet 790. Liquid transfer machine 100 may be an acoustic liquid transfer machine. Liquid transfer machine 100 and/or computer system 601-1 may be considered remote clients of computer system 601-2. In some embodiments, computer system 601-2 provides services to one or both of liquid transfer machine 100 and computer system 601-1 as part of a contract or in exchange for compensation.

According to some embodiments, liquid transfer machine 100 or components thereof (such as controller 201) may send an initial picklist to computer 601-2 via Internet 790 with a request for an ordered picklist to be determined. Computer 601-2 may determine an ordered picklist from this initial picklist in any of the manners described herein with reference to Equation 1, Equation 2, or the like. Computer system 601-2 may then provide this ordered picklist to one or both remote clients (e.g., liquid transfer machine 100, computer 601-1, or both).

According to some embodiments, computer system 601-1 may send an initial picklist to computer 601-2 via Internet 790 with a request for an ordered picklist to be determined. Computer system 601-2 may determine an ordered picklist from this initial picklist in any of the manners described herein with reference to Equation 1, Equation 2, or the like. Computer system 601-2 may then provide this ordered picklist to one or both remote clients (e.g., liquid transfer machine 100, computer 601-1, or both).

Example Computer System Environment

Figure 9:
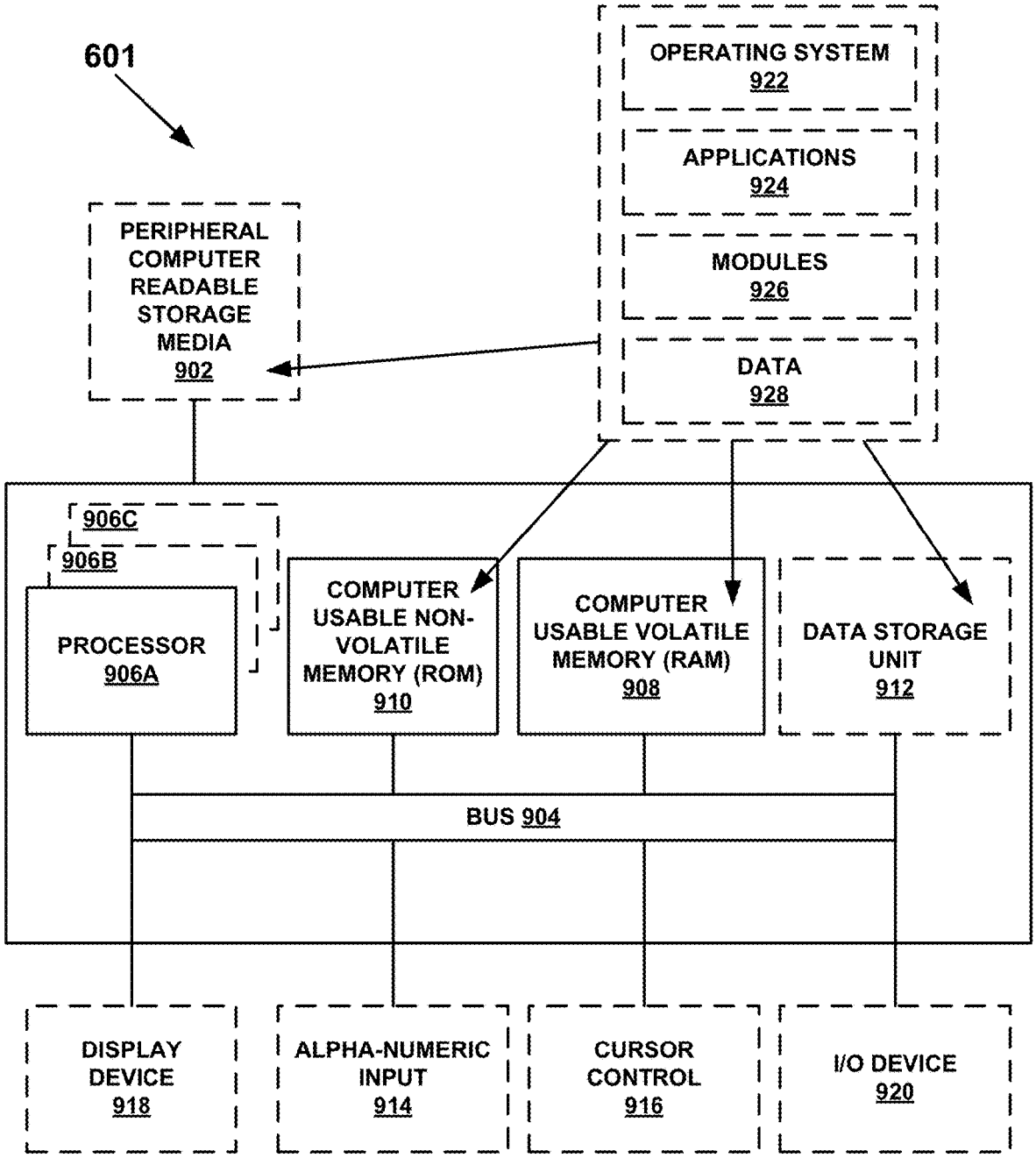
FIG. 9 illustrates components of an example computer system, with which or upon which, various embodiments may be implemented.

FIG. 9 illustrates components of an example computer system 601, with which or upon which, various embodiments may be implemented. With reference now to FIG. 9, all or portions of some embodiments described herein are composed of computer-readable and computer-executable instructions that reside, for example, in computer-usable/computer-readable storage media of a computer system. That is, FIG. 9 illustrates one example of a type of computer system 601 (e.g., computer system 601-1, 601-2) that can be used in accordance with or to implement various embodiments which are discussed herein. It is appreciated that computer system 601 of FIG. 9 is only an example and that embodiments as described herein can operate on or within a number of different computer systems including, but not limited to, general purpose networked computer systems, embedded computer systems, routers, switches, server devices, client devices, various intermediate devices/nodes, stand alone computer systems, media centers, handheld computer systems, multi-media devices, and the like.

System 600 of FIG. 9 includes an address/data bus 904 for communicating information, and a processor 906A coupled with bus 904 for processing information and instructions. As depicted in FIG. 9, system 600 is also well suited to a multi-processor environment in which a plurality of processors 906A, 906B, and 906C are present. Conversely, system 600 is also well suited to having a single processor such as, for example, processor 906A. Processors 906A, 906B, and 906C may be any of various types of microprocessors. Computer system 601 also includes data storage features such as a computer usable volatile memory 908, e.g., random access memory (RAM), coupled with bus 904 for storing information and instructions for processors 906A, 906B, and 906C. System 600 also includes computer usable non-volatile memory 910, e.g., read only memory (ROM), coupled with bus 904 for storing static information and instructions for processors 906A, 906B, and 906C.

In some embodiments a data storage unit 912 (e.g., a magnetic or optical disk and disk drive) is coupled with bus 904 for storing information and instructions.

In some embodiments, computer system 601 is well adapted to having peripheral computer-readable storage media 902 such as, for example, a floppy disk, a compact disc, digital versatile disc, other disc based storage, universal serial bus flash drive, removable memory card, and the like coupled thereto.

Computer system 601 may also include an optional alphanumeric input device 914 including alphanumeric and function keys coupled with bus 904 for communicating information and command selections to processor 906A or processors 906A, 906B, and 906C. Computer system 601 may also include an optional cursor control device 916 coupled with bus 904 for communicating user input information and command selections to processor 906A or processors 906A, 906B, and 906C. In some embodiments, system 600 also includes an optional display device 918 coupled with bus 904 for displaying information.

Optional cursor control device 916 allows the computer user to dynamically signal the movement of a visible symbol (cursor) on a display screen of display device 918 and indicate user selections of selectable items displayed on display device 918. Alternatively, it will be appreciated that a cursor can be directed and/or activated via input from optional alphanumeric input device 914 using special keys and key sequence commands. Computer system 601 is also well suited to having a cursor directed by other means such as, for example, voice commands.

In some embodiments, computer system 601 also includes an I/O device 920 for coupling system 600 with external entities. For example, in one embodiment, I/O device 920 is a modem for enabling wired or wireless communications between system 600 and an external device or network such as, but not limited to, the Internet.

Referring still to FIG. 9, various other components are depicted for system 600. Specifically, when present, an operating system 922, applications 924, modules 926, and data 928 are shown as typically residing in one or some combination of computer usable volatile memory 908 (e.g., RAM), computer usable non-volatile memory 910 (e.g., ROM), and data storage unit 912. In some embodiments, all or portions of various embodiments described herein are stored, for example, as an application 924 and/or module 926 in memory locations within RAM 908, computer-readable storage media within data storage unit 912, peripheral computer-readable storage media 902, and/or other computer-readable storage media.

Example Methods of Operation

Figure 10A:
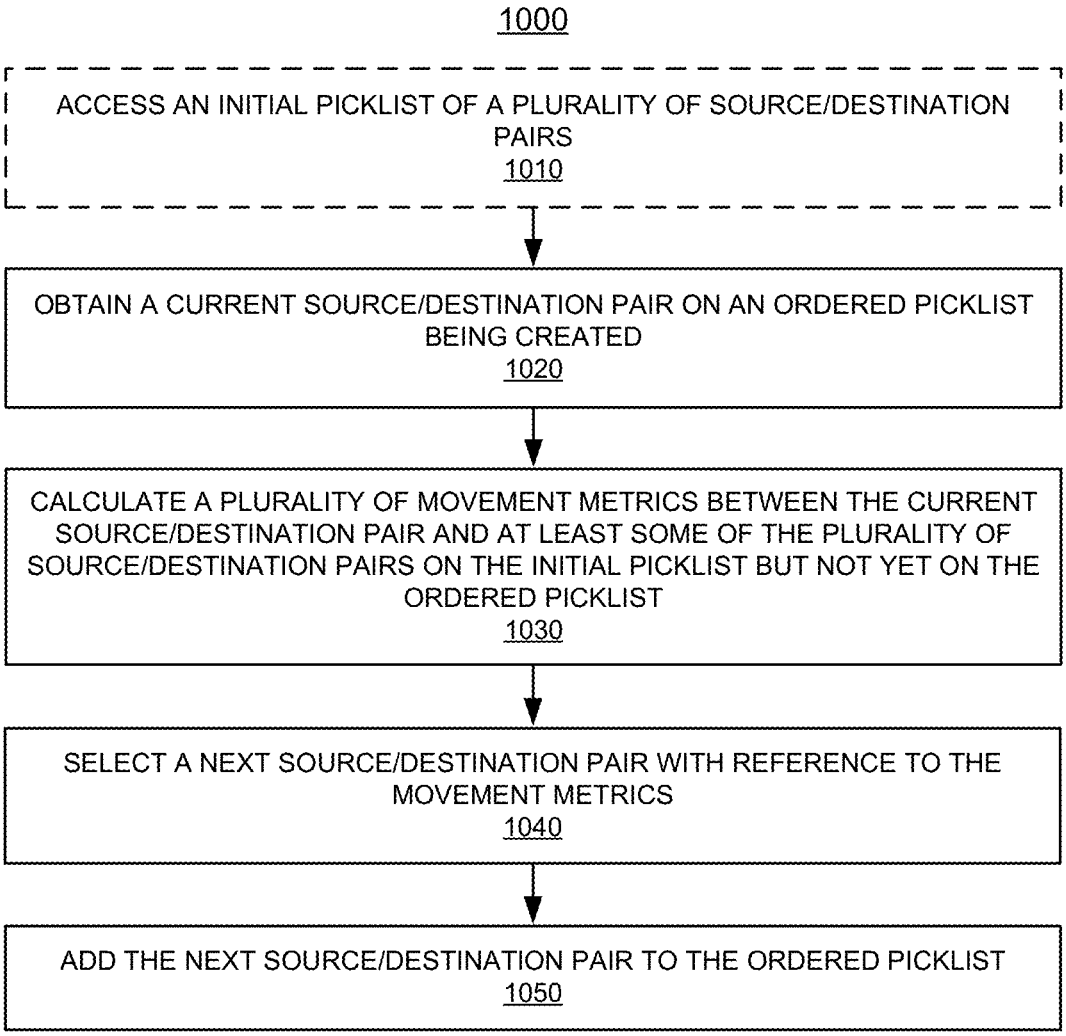
FIGS. 10A-10C illustrate a flow diagram of an example method of determining an ordered picklist from an initial picklist and further describe a method of performing liquid transfer using an acoustic liquid transfer machine, in accordance with various embodiments.
Figure 10B:
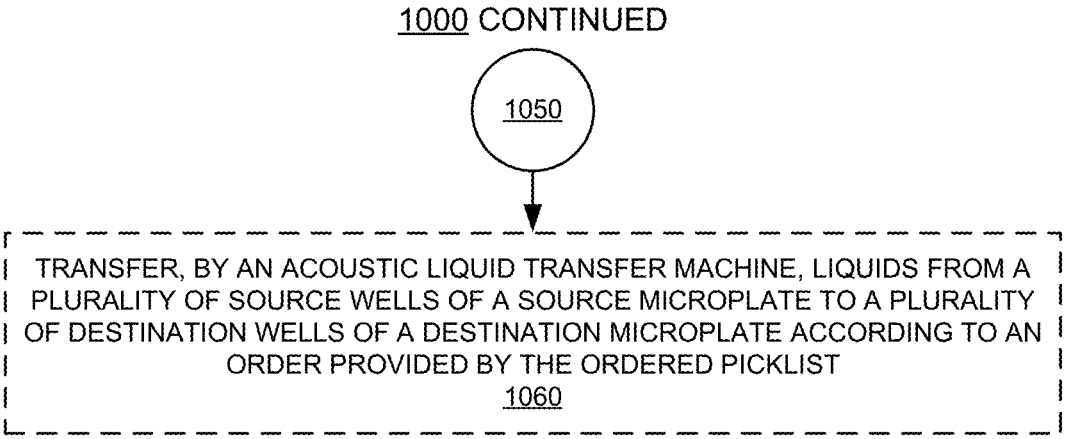
Figure 10C:
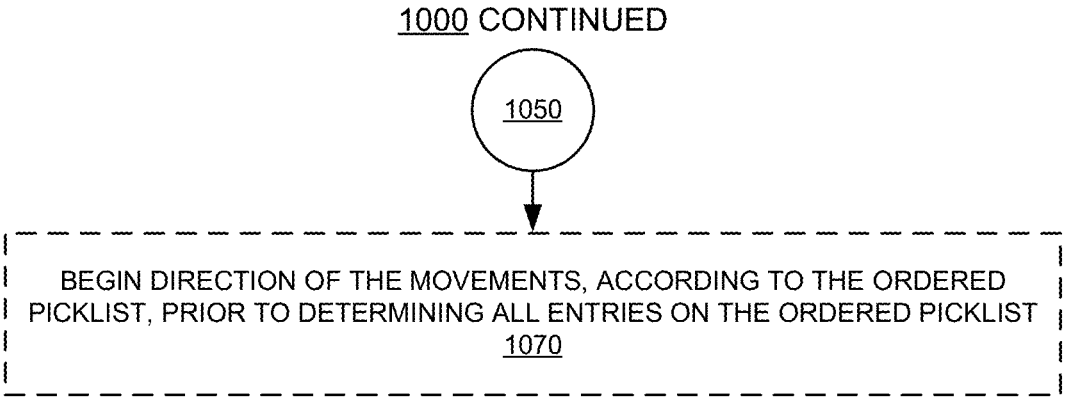

FIGS. 10A-10C illustrate a flow diagram of an example method of determining an ordered picklist from an initial picklist and further describe a method of performing liquid transfer using an acoustic liquid transfer machine, such as acoustic liquid transfer machine 100 of FIG. 2, in accordance with various embodiments. Procedures of the methods illustrated by flow diagram 1000 of FIGS. 10A-10C will be described with reference to aspects and/or components of one or more of FIGS. 1-9. It is appreciated that in some embodiments, the procedures may be performed in a different order than described in a flow diagram, that some of the described procedures may not be performed, and/or that one or more additional procedures to those described may be performed. Flow diagram 1000 include some procedures that, in various embodiments, are carried out by one or more processors or controllers (e.g., a processor 906, a controller 201, a computer 601, or the like) under the control of computer-readable and computer-executable instructions that are stored on non-transitory computer-readable storage media (e.g., peripheral computer-readable storage media 902, ROM 910, RAM 908, data storage unit 912, or the like). It is further appreciated that one or more procedures described in flow diagram 1000 may be implemented in hardware, or a combination of hardware with firmware and/or software.

With reference to FIG. 10A, at procedure 1010 of flow diagram 1000, in various embodiments, an initial picklist of a plurality of source/destination pairs may be accessed The accessing may be accomplished by a processor 906 or a controller 201 if the picklist is not already available to the processor 906 or the controller 201. The picklist illustrated in Table 1 is one example of an initial picklist. From this initial picklist of a plurality of source/destination pairs, an ordered picklist is determined which comprises a plurality of the source/destination pairs. The determining may be accomplished by processor 906 or controller 201. This plurality of source/destination pairs may include some or all of the source/destination pairs in the initial picklist. As discussed above, the source/destination pairs represent a source well on a source microplate 110 from which liquid will be transferred to a destination well on a destination microplate 120.

With continued reference to FIG. 10A, at procedure 1020 of flow diagram 1000, in various embodiments, a current source/destination pair on the ordered picklist is obtained. The obtaining may be accomplished by processor 906 or controller 201. The current source/destination pair can be obtained or selected in numerous manners. In one example, the current source/destination pair may be the first source/destination pair on an initial picklist. In another example, the current source destination pair may be the current pick on a picklist which has been partially completed. In another example, the current source/destination pair may be a default source/destination orientation of components of an acoustic liquid transfer machine after loading of a source microplate and a destination microplate. In another embodiment, the current source/destination pair may be chosen to be at a particular location, such as at a pair of aligned corners of a source microplate and a destination microplate. In some embodiments, the controller 201 may be the same component as processor 906. In some embodiments, the processor is disposed as a portion of the acoustic liquid transfer machine 100. For example, in some embodiments, the controller 201 may the same component as processor 906 or else a processor such as processor 906 may be included in acoustic liquid transfer machine 100 in addition to controller 201. In some embodiments, the processor is located remotely from the acoustic liquid transfer machine 100, such as in computer 601-1 of FIG. 6 or in computer 601-2 of FIGS. 7 and 8.

With continued reference to FIG. 10A, at procedure 1030 of flow diagram 1000, in various embodiments, a plurality of movement metrics is calculated between the current source/destination pair and at least some of the plurality of source/destination pairs not yet on the ordered picklist. The calculating may be accomplished by processor 906 or controller 201 in the manner previously described in conjunction with Equation 1, Equation 2, or the like. In some embodiments, a movement metric of the plurality of movement metrics comprises a distance. In some embodiments, a movement metric of the plurality of movement metrics comprises a timespan. A timespan may include one or more of a ramp-up travel time, a ramp-down travel time, a steady state travel time, and a settling time. As described above, in some embodiments, a movement metric of the plurality of movement metrics may associated with movement of an acoustic transducer 230 relative to a source microplate 110 and/or its holding component 210. In some embodiments, a movement metric of the plurality of movement metrics may associated with movement of a destination microplate 120 and/or its holding component 220 with respect to a source microplate 110 and/or its holding component 210. In some embodiments, a movement metric of the plurality of movement metrics may associated with movement of a source microplate 110 and/or its holding component 210.

In some embodiments, a movement metric of the plurality of movement metrics comprises a larger of a first distance to be moved by a first moving component of the acoustic liquid transfer machine when repositioned from the current source/destination pair to a source/destination pair of the plurality of source/destination pairs not yet on the ordered picklist and a second distance moved by a second moving component of the acoustic liquid transfer machine when repositioning from the current source/destination pair the source/destination pair of the plurality of source/destination pairs not yet on the ordered picklist. In this manner, movements which would be required for two different components are compared and the longest distance moved is chosen as the metric associated with repositioning to the source destination pair that is not yet on the ordered picklist because it is presumed to be the limiting factor in a situation where the two moving components move at the same/substantially the same speed. In some embodiments, the first moving component is the destination holding component 220 (or the destination microplate 120 being held/moved by it); while the second moving component is the or the acoustic transducer 230. It should be appreciated that, in some embodiments, the acoustic transducer 230 is the first moving component, while the second moving component is the destination holding component 220 (or the destination microplate 120 being held/moved by it). In this same manner, timespans for repositioning movements for two moving components may be compared and the longest timespan chosen for the metric associated with repositioning to the source destination pair that is not yet on the ordered picklist.

With continued reference to FIG. 10A, at procedure 1040 of flow diagram 1000, in various embodiments, with reference to the movement metrics, a next source/destination pair is selected from the plurality of source/destination pairs not yet on the ordered picklist. The selecting may be accomplished by processor 906 or controller 201. The selecting may be performed by choosing the source/destination pair, not yet on the ordered picklist, which has the smallest of the calculated movement metrics.

With continued reference to FIG. 10A, at procedure 1050 of flow diagram 1000, in various embodiments, the next source/destination pair that was selected is then added to the ordered picklist. For example, it may be added as the next ordered pick in a sequence of ordered picks. The adding to the ordered picklist may be accomplished by processor 906 or controller 201.

With reference to FIG. 10B, at procedure 1060 of flow diagram 1000, in various embodiments, the method as described in 1050 further comprises the acoustic liquid transfer machine 100 transferring liquids from a plurality of source wells of a source microplate to a plurality of destination wells of a destination microplate according to an order provided by the ordered picklist. A processor 906 or controller 201 may direct movements and actions of components of acoustic liquid transfer machine 100 to effect the transfers. For example, an acoustic liquid transfer machine may perform liquid transfers in the order specified by the ordered picklist of Table 2. In the manner described in conjunction with FIGS. 4A-4F, this may comprise positioning, by the acoustic liquid transfer machine 100, a destination well of the plurality of destination wells on a destination microplate 120 relative to a source well of the plurality of source wells on a source microplate 110 according to the next source/destination pair of the ordered picklist. This may additionally or alternatively comprise positioning an acoustic transducer 230 with respect to the source well. After positioning is complete, a specified amount of liquid is transferred, by the acoustic liquid transfer machine 100, from the source well to the destination well.

With reference to FIG. 10C, at procedure 1070 of flow diagram 1000, in various embodiments, the method as described in 1050 further comprises commencing liquid transfer by beginning the direction of the movements of components of the acoustic liquid transfer machine and the liquid transfers between source/destination pairs, according to the entries which have already been determined for the ordered picklist, but prior to determining all entries on the ordered picklist. For example, before processor 906 or controller 201 has finished determining all of the entries which will eventually be on the ordered picklist, acoustic liquid transfer machine 100 can begin moving components and performing liquid transfers in accordance with any entries which have already been determined. With reference to Table 2, eventually 12 entries will be determined for this ordered picklist. At any time after the first entry is determined acoustic liquid transfer machine 100 can begin moving components and performing liquid transfers according to the ordered entries while the other ordered entries are still being determined.

Figure 11:
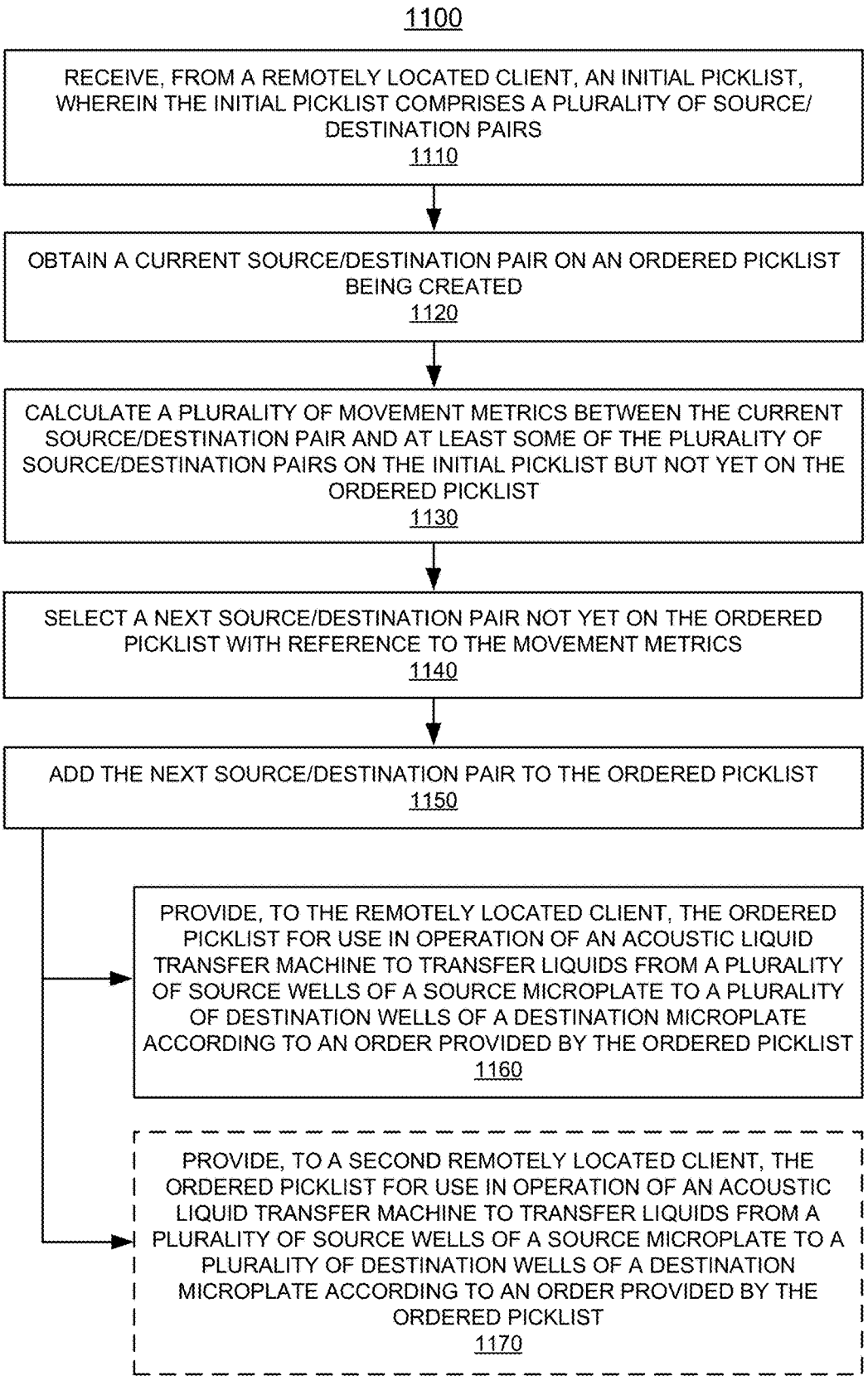
FIG. 11 illustrates a flow diagram of an example method of providing an ordered picklist from an initial picklist, in accordance with various embodiments.

FIG. 11 illustrates a flow diagram of an example method of providing an ordered picklist from an initial picklist, in accordance with various embodiments. Procedures of the methods illustrated by flow diagram 1100 of FIG. 11 will be described with reference to aspects and/or components of one or more of FIGS. 1-10C. It is appreciated that in some embodiments, the procedures may be performed in a different order than described in a flow diagram, that some of the described procedures may not be performed, and/or that one or more additional procedures to those described may be performed. Flow diagram 1100 include some procedures that, in various embodiments, are carried out by one or more processors or controllers (e.g., a processor 906, a controller 201, a computer 601, or the like) under the control of computer-readable and computer-executable instructions that are stored on non-transitory computer-readable storage media (e.g., peripheral computer-readable storage media 902, ROM 910, RAM 908, data storage unit 912, or the like). It is further appreciated that one or more procedures described in flow diagram 1100 may be implemented in hardware, or a combination of hardware with firmware and/or software.

With reference to FIG. 11, at procedure 1110 of flow diagram 1100, in various embodiments, a remotely located computer such as computer 601-2 of FIG. 7 or FIG. 8 receives, from a remotely located client, an initial picklist. With reference to FIGS. 7 and 8, the remotely located client may comprise an acoustic liquid transfer machine 100 or a computer 601-1. Table 1 illustrates an example of an initial picklist. The initial picklist comprises a plurality of source/destination pairs. A source in a source/destination pair of the plurality of source/destination pairs represents a source well on a source microplate 110 from which a liquid will be transferred. A destination in the source/destination pair represents a destination well on a destination microplate 120 to which the liquid will be transferred.

With continued reference to FIG. 11, at procedure 1120 of flow diagram 1100, in various embodiments, a current source/destination pair on the ordered picklist is obtained. The obtaining may be accomplished by one or more processors 906 of computer system 601-2. In some embodiments, the current source destination pair may be a source/destination pair designated as a default starting location of components of acoustic liquid transfer machine 100, and this default starting location source/destination pair may not appear on the initial picklist. In some embodiments, the current source/destination pair may be obtained from the initial picklist. For example, it may be a source/destination pair of the initial picklist where liquid is presently being transferred or has just been being transferred.

With continued reference to FIG. 11, at procedure 1130 of flow diagram 1100, in various embodiments, a plurality of movement metrics are calculated between the current source/destination pair and at least some of the plurality of source/destination pairs not yet on the ordered picklist. The calculating may be accomplished by one or more processors 906 of computer system 601-2 in the manner previously described in conjunction with Equation 1, Equation 2, or the like. In some embodiments, a movement metric of the plurality of movement metrics comprises a distance. In some embodiments, a movement metric of the plurality of movement metrics comprises a timespan. A timespan may include one or more of a ramp-up travel time, a ramp-down travel time, a steady state travel time, and a settling time. As described above, in some embodiments, a movement metric of the plurality of movement metrics may associated with movement of an acoustic transducer 230 relative to a source microplate 110 and/or its holding component 210. In some embodiments, a movement metric of the plurality of movement metrics may associated with movement of a destination microplate 120 and/or its holding component 220 with respect to a source microplate 110 and/or its holding component 210. In some embodiments, a movement metric of the plurality of movement metrics may associated with movement of a source microplate 110 and/or its holding component 210.

In some embodiments, a movement metric of the plurality of movement metrics comprises a larger of a first distance to be moved by a first moving component of the acoustic liquid transfer machine when repositioned from the current source/destination pair to a source/destination pair of the plurality of source/destination pairs not yet on the ordered picklist and a second distance moved by a second moving component of the acoustic liquid transfer machine when repositioning from the current source/destination pair the source/destination pair of the plurality of source/destination pairs not yet on the ordered picklist. In this manner, movements which would be required for two different components are compared and the longest distance moved is chosen as the metric associated with repositioning to the source destination pair that is not yet on the ordered picklist because it is presumed to be the limiting factor in a situation where the two moving components move at the same/substantially the same speed. In some embodiments, the first moving component is the destination holding component 220 (or the destination microplate 120 being held/moved by it); while the second moving component is the or the acoustic transducer 230. It should be appreciated that, in some embodiments, the acoustic transducer 230 is the first moving component, while the second moving component is the destination holding component 220 (or the destination microplate 120 being held/moved by it). In this same manner, timespans for repositioning movements for two moving components may be compared and the longest timespan chosen for the metric associated with repositioning to the source destination pair that is not yet on the ordered picklist.

With continued reference to FIG. 11, at procedure 1140 of flow diagram 1100, in various embodiments, with reference to the movement metrics, a next source/destination pair is selected from the plurality of source/destination pairs not yet on the ordered picklist. The selecting may be accomplished by one or more processors 906 of computer system 601-2. The selecting may be performed by choosing the source/destination pair not yet on the ordered picklist, which has the smallest of the calculated movement metrics.

With continued reference to FIG. 11, at procedure 1150 of flow diagram 1100, in various embodiments, the next source/destination pair is added to the ordered picklist. For example, it may be added as the next ordered pick in a sequence of ordered picks in the manner illustrated in Table 2. The adding to the ordered picklist may be accomplished by one or more processors 906 of computer system 601-2.

With reference to FIG. 11, at procedure 1160 of flow diagram 1100, in various embodiments, computer system 601-2 provides, to the remotely located client (e.g., acoustic liquid transfer machine 100 or computer system 601-1), the ordered picklist for use in operation of an acoustic liquid transfer machine 100 to transfer liquids from a plurality of source wells of a source microplate 110 to a plurality of destination wells of a destination microplate 120 according to an order provided by the ordered picklist. Table 2 illustrates an ordered picklist generated from the initial picklist depicted in Table 1.

With reference to FIG. 11, at procedure 1170 of flow diagram 1100, in various embodiments, additionally or alternatively to the actions of procedure 1160, computer system 601-2 provides, to a second remotely located client, the ordered picklist for use in operation of an acoustic liquid transfer machine 100 to transfer liquids from a plurality of source wells of a source microplate 110 to a plurality of destination wells of a destination microplate 120 according to an order provided by the ordered picklist. For example, with reference to FIG. 8, in an example where computer system 601-1 is the initial remote client, the ordered picklist may be provided from computer system 601-2 (via internet 790) to acoustic liquid transfer machine 100. This may be accomplished at the direction of the first client (e.g., computer system 601-1) and may be useful in an embodiment when an acoustic liquid transfer machine 100 and a computer system 601-1 are not local to one another.

CONCLUSION

The examples set forth herein were presented in order to best explain, to describe particular applications, and to thereby enable those skilled in the art to make and use embodiments of the described examples. However, those skilled in the art will recognize that the foregoing description and examples have been presented for the purposes of illustration and example only. The description as set forth is not intended to be exhaustive or to limit the embodiments to the precise form disclosed. Rather, the specific features and acts described above are disclosed as example forms of implementing the claims.

Reference throughout this document to "one embodiment," "certain embodiments," "an embodiment," "various embodiments," "some embodiments," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular aspects, features, structures, or characteristics of any embodiment may be combined in any suitable manner with one or more other aspects, features, structures, or characteristics of one or more other embodiments without limitation.

What is claimed is:

1. An acoustic liquid transfer system comprising:

a processor configured to:

access an initial picklist of a plurality of source/destination pairs;

obtain a current source/destination pair on an ordered picklist being created by the processor;

calculate a plurality of movement metrics between the current source/destination pair and at least some of the plurality of source/destination pairs on the initial picklist but not yet on the ordered picklist;

select a next source/destination pair with reference to the movement metrics; and add the next source/destination pair to the ordered picklist;

a source holding component configured to hold a source microplate comprising a plurality of source wells;

a destination holding component configured to hold a destination microplate comprising a plurality of destination wells;

an acoustic transducer configured to emit acoustic energy to cause liquid to transfer between a source well and a destination well represented by the next source/destination pair; and a controller configured to direct movements, according to the ordered picklist, of one or more of the source holding component, the destination holding component, and the acoustic transducer.

2. The acoustic liquid transfer system of claim 1, wherein the controller is further configured to:

begin direction of the movements, according to the ordered picklist, prior to the processor determining all entries on the ordered picklist.

3. The acoustic liquid transfer system of claim 1, wherein a movement metric of the plurality of movement metrics is a distance.

4. The acoustic liquid transfer system of claim 1, wherein a movement metric of the plurality of movement metrics is a timespan.

5. The acoustic liquid transfer system of claim 4, wherein a portion of the timespan comprises at least one of: a ramp-up travel time, a ramp-down travel time, a steady state travel time, and a settling time.

6. The acoustic liquid transfer system of claim 1, wherein a movement metric of the plurality of movement metrics comprises one of:

a movement of the acoustic transducer relative to the source holding component; and a movement of the destination holding component relative to the source holding component.

7. The acoustic liquid transfer system of claim 1, further comprising an acoustic liquid transfer machine; wherein the controller and the processor are the same component disposed within the acoustic liquid transfer machine.

8. The acoustic liquid transfer system of claim 1, further comprising a machine; wherein the controller and the processor are different and the processor is disposed apart from the machine in which the controller is disposed.

9. A method of performing liquid transfer using an acoustic liquid transfer machine, the method comprising:

from an initial picklist of a plurality of source/destination pairs, determining an ordered picklist comprising a plurality of the source/destination pairs, by:

obtaining, by a processor, a current source/destination pair on the ordered picklist;

calculating, by the processor, a plurality of movement metrics between the current source/destination pair and at least some of the plurality of source/destination pairs not yet on the ordered picklist;

with reference to the plurality of movement metrics, selecting, by the processor, a next source/destination pair from the plurality of source/destination pairs not yet on the ordered picklist; and adding, by the processor, the next source/destination pair to the ordered picklist; and transferring, by the acoustic liquid transfer machine, liquids from a plurality of source wells of a source microplate to a plurality of destination wells of a destination microplate according to an order provided by the ordered picklist.

10. The method as recited in claim 9, wherein the determining of an ordered picklist comprising a plurality of the source/destination pairs comprises:

determining the ordered picklist to comprise of the source/destination pairs in the initial picklist.

11. The method as recited in claim 9, wherein the obtaining, by a processor, a current source/destination pair on the ordered picklist comprises:

obtaining, by the processor, the current source/destination pair on the ordered picklist, wherein the processor is disposed as a portion of the acoustic liquid transfer machine.

12. The method as recited in claim 9, wherein the obtaining, by a processor, a current source/destination pair on the ordered picklist comprises:

obtaining, by the processor, the current source/destination pair on the ordered picklist wherein the processor is located remotely from the acoustic liquid transfer machine.

13. The method as recited in claim 9, wherein the calculating, by the processor, a plurality of movement metrics between the current source/destination pair and at least some of the plurality of source/destination pairs not yet on the ordered picklist comprises:

calculating, by the processor, the plurality of movement metrics between the current source/destination pair and the at least some of the plurality of source/destination pairs not yet on the ordered picklist, wherein a movement metric of the plurality of movement metrics comprises a distance.

14. The method as recited in claim 9, wherein the calculating, by the processor, a plurality of movement metrics between the current source/destination pair and at least some of the plurality of source/destination pairs not yet on the ordered picklist comprises:

calculating, by the processor, the plurality of movement metrics between the current source/destination pair and the at least some of the plurality of source/destination pairs not yet on the ordered picklist, wherein a movement metric of the plurality of movement metrics comprises a timespan.

15. The method as recited in claim 9, wherein the calculating, by the processor, a plurality of movement metrics between the current source/destination pair and at least some of the plurality of source/destination pairs not yet on the ordered picklist comprises:

calculating, by the processor, the plurality of movement metrics between the current source/destination pair and the at least some of the plurality of source/destination pairs not yet on the ordered picklist, wherein a movement metric of the plurality of movement metrics comprises one of:

movement of an acoustic transducer relative to the source microplate; and movement of the destination microplate with respect to the source microplate.

16. The method as recited in claim 9, wherein the transferring, by the acoustic liquid transfer machine, liquids from a plurality of source wells of a source microplate to a plurality of destination wells of a destination microplate according to an order provided by the ordered picklist comprises:

positioning, by the acoustic liquid transfer machine, a destination well of the plurality of destination wells relative to a source well of the plurality of source wells according to the next source/destination pair of the ordered picklist; and transferring, by the acoustic liquid transfer machine, liquid from the source well to the destination well.

17. A non-transitory computer readable storage medium comprising instructions embodied thereon, which when executed, cause a processor to perform a method of determining, from an initial picklist of a plurality of source/destination pairs, an ordered picklist comprising a plurality of the source/destination pairs, the method comprising:

obtaining from the initial picklist, by the processor, a current source/destination pair on the ordered picklist;

calculating, by the processor, a plurality of movement metrics between the current source/destination pair and at least some of the plurality of source/destination pairs not yet on the ordered picklist;

with reference to the plurality of movement metrics, selecting, by the processor, a next source/destination pair from the plurality of source/destination pairs not yet on the ordered picklist; and adding, by the processor, the next source/destination pair to the ordered picklist.

18. The non-transitory computer readable storage medium as recited in claim 17, calculating, by the processor, a plurality of movement metrics between the current source/destination pair and at least some of the plurality of source/destination pairs not yet on the ordered picklist comprises:

calculating, by the processor, the plurality of movement metrics between the current source/destination pair and the at least some of the plurality of source/destination pairs not yet on the ordered picklist, wherein a movement metric of the plurality of movement metrics comprises a distance.

19. The non-transitory computer readable storage medium as recited in claim 17, calculating, by the processor, a plurality of movement metrics between the current source/destination pair and at least some of the plurality of source/destination pairs not yet on the ordered picklist comprises:

calculating, by the processor, the plurality of movement metrics between the current source/destination pair and the at least some of the plurality of source/destination pairs not yet on the ordered picklist, wherein a movement metric of the plurality of movement metrics comprises a timespan.

20. The non-transitory computer readable storage medium as recited in claim 17, calculating, by the processor, a plurality of movement metrics between the current source/destination pair and at least some of the plurality of source/destination pairs not yet on the ordered picklist comprises:

calculating, by the processor, the plurality of movement metrics between the current source/destination pair and the at least some of the plurality of source/destination pairs not yet on the ordered picklist, wherein a movement metric of the plurality of movement metrics comprises one of:

movement of an acoustic transducer relative to a source microplate; and movement of a destination microplate with respect to the source microplate.

21. A method of providing an ordered picklist from an initial picklist for operating an acoustic liquid transfer machine, the method comprising:

receiving, by a processor, from a remotely located client, the initial picklist, wherein the initial picklist comprises a plurality of source/destination pairs, wherein a source in a source/destination pair of the plurality of source/destination pairs represents a source well on a source microplate from which a liquid will be transferred, and wherein a destination in the source/destination pair represents a destination well on a destination microplate to which the liquid will be transferred;

obtaining from the initial picklist, by the processor, a current source/destination pair on the ordered picklist;

calculating, by the processor, a plurality of movement metrics between the current source/destination pair and at least some of the plurality of source/destination pairs not yet on the ordered picklist, wherein in a movement metric of the plurality of movement metrics comprises a larger of a first distance to be moved by a first moving component of the acoustic liquid transfer machine when repositioned from the current source/destination pair to a source/destination pair of the plurality of source/destination pairs not yet on the ordered picklist and a second distance moved by a second moving component of the acoustic liquid transfer machine when repositioning from the current source/destination pair the source/destination pair of the plurality of source/destination pairs not yet on the ordered picklist;

with reference to the movement metrics, selecting, by the processor, a next source/destination pair from the plurality of source/destination pairs not yet on the ordered picklist;

adding, by the processor, the next source/destination pair to the ordered picklist; and providing, to the remotely located client, the ordered picklist for use in operation of the acoustic liquid transfer machine to transfer liquids from a plurality of source wells of the source microplate to a plurality of destination wells of the destination microplate according to an order provided by the ordered picklist.

* * * * *